US007880759B2

(12) United States Patent
Toguchi

(10) Patent No.: US 7,880,759 B2
(45) Date of Patent: Feb. 1, 2011

(54) LINE HEAD AND IMAGE FORMING DEVICE USING THE SAME

(75) Inventor: Takeharu Toguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 46 days.

(21) Appl. No.: 12/353,724

(22) Filed: Jan. 14, 2009

(65) Prior Publication Data

US 2009/0185025 A1 Jul. 23, 2009

(30) Foreign Application Priority Data

Jan. 17, 2008 (JP) ..... 2008-007832
Aug. 13, 2008 (JP) ..... 2008-208367

(51) Int. Cl.
*B41J 2/45* (2006.01)

(52) U.S. Cl. ..... 347/238

(58) Field of Classification Search ..... 347/237, 347/238, 244, 247, 258, 241, 256
See application file for complete search history.

(56) References Cited

U.S. PATENT DOCUMENTS 4,524,372 A * 6/1985 De Cock et al. ..... 347/238
4,763,041 A * 8/1988 Segawa ..... 313/496
6,188,086 B1 * 2/2001 Masuda et al. ..... 257/98
6,330,017 B1 * 12/2001 Suzuki ..... 347/238
6,559,879 B1 * 5/2003 Kobayashi et al. ..... 347/238
7,728,856 B2 * 6/2010 Chino ..... 347/135

FOREIGN PATENT DOCUMENTS

JP 2004-209777 7/2004

* cited by examiner

*Primary Examiner*—Hai C Pham
(74) *Attorney, Agent, or Firm*—DLA Piper LLP (US)

(57) ABSTRACT

A line head includes a substrate, light emitting elements disposed on the substrate, drive circuits that drive the light emitting elements, and wirings that electrically connect the drive circuits and the light emitting elements. The light emitting elements form n (n≧2) light emitting element rows. The drive circuits are electrically connected with the wirings to light emitting elements belonging to a number of light emitting element rows equal to or smaller than n−1.

6 Claims, 22 Drawing Sheets

LINE HEAD AND IMAGE FORMING DEVICE USING THE SAME

CROSS-REFERENCE TO RELATED APPLICATIONS

This application claims the benefit of priority under 35 USC 119 of Japanese patent application no. 2008-007832, filed on Jan. 17, 2008, and Japanese patent application no. 2008-208367, filed on Aug. 13, 2008, which are incorporated herein by reference.

BACKGROUND

1. Technical Field

The present invention relates to a line head and an image forming device using the line head that simplify wiring connections where light sources are arranged two-dimensionally to be connected to a drive circuit, and that rationally perform image formation.

2. Related Art

A toner image formation section of an electrophotographic system generally includes a photoconductor drum as an image carrier having a photoconductive layer on its outer circumferential surface, a charging section for evenly charging the outer circumferential surface of the photoconductor drum, an exposure section for selectively exposing the outer circumferential surface thus evenly charged by the charging section to form an electrostatic latent image, and a development section for providing toner as a development agent to the electrostatic latent image thus formed by the exposure section to make the electrostatic latent image a visible image (a toner image).

An exposure section is known that uses a line head provided with a light emitter array. Light emitting elements such as LEDs or organic EL elements are provided in the light emitter array. The output light from the light emitting elements is provided to the photoconductor drum through an imaging lens. A lens with positive optical power (e.g., a SELFOC™ lens) and a lens with negative optical power (e.g., a microlens) may be used as the imaging lens. For example, JP-A-2004-209777 describes a case in which the output light of light emitting elements arranged two-dimensionally in a light emitter array is provided to a photoconductor drum through an imaging lens with positive optical power to form a latent image. The light emitting elements are controlled by a drive circuit.

FIG. 8 is a block diagram illustrating the drive circuit of JP-A-2004-209777. In FIG. 8, main controller 80 is connected to a control section 70 of a line head. A plurality of light emitting elements 61 for which organic EL elements are used is arranged in an axial direction (the X or main-scanning direction) of the photoconductor drum and a rotational direction (the Y or sub-scanning direction) of the photoconductor drum. A plurality of rows of the light emitting elements 61 is arranged in the Y direction for the purpose of improvement of resolution and so on. The light emitting elements 61 are connected to a drive circuit 76. The image data formed by the main controller 80 is transmitted to the control section 70, and temporarily stored in a memory 77. A control circuit 75 retrieves the image data stored in the memory 77, and forms a drive signal to supply each of the light emitting elements 61 with the drive signal via the drive circuit 76.

When the light emitting elements are arranged two-dimensionally, the drive circuit must be operated after executing reordering of the image data so as to be reversed in the axial and rotational directions of the photoconductor drum in a configuration using microlenses with negative optical power as the imaging lenses. However, imaging lenses with positive optical power are used in the line head of JP-A-2004-209777. Therefore, if the technology of JP-A-2004-209777 is used as it is, there is a problem in that a latent image different from the original image in the rotational direction of the photoconductor drum is formed, and the image quality is therefore degraded.

Further, in a line head having a number of light emitting elements arranged in the X and Y directions of the substrate as shown in FIG. 8, since the wiring connections between the light emitting elements and the drive circuit is made in a narrow space, there is a problem in that making the wiring connections is troublesome. In particular, in a configuration using microlenses with negative optical power as the imaging lenses, since reversal of image data as described above is required, the wiring connections between the light emitting elements and the drive circuit is further complicated.

SUMMARY

In view of these problems, the present invention provides a line head and an image forming device using the line head that simplify wiring connections in a case in which light sources are arranged two-dimensionally to be connected to a drive circuit, and rationally perform image formation.

A line head according to an aspect of the invention includes a substrate, light emitting elements disposed on the substrate, drive circuits that drive the light emitting elements, and wirings that electrically connect the drive circuits and the light emitting element. The light emitting elements form n (n is an integral number equal to or greater than 2) light emitting element rows, and the drive circuits are electrically connected with the wirings to light emitting elements belonging to a number of light emitting element rows equal to or smaller than n−1.

According to another aspect of the invention, in the line head described above, there is further included at least one imaging optical system that images the light from the light emitting elements forming the n light emitting element rows.

According to another aspect of the invention, in the line head described above, there is further included at least one flexible printed circuit board electrically connected to the wirings, and the drive circuits are disposed on the flexible printed circuit board.

According to another aspect of the invention, in the line head described above, the number of drive circuits is equal to or greater than 2

According to another aspect of the invention, in the line head described above, the drive circuits are each formed of a driver IC.

According to another aspect of the invention, in the line head described above, the imaging optical system has negative optical power.

According to still another aspect of the invention, an image forming device is provided including a photoconductor drum, a line head including a substrate, light emitting elements disposed on the substrate, drive circuit that drive the light emitting elements, wirings that electrically connect the drive circuit and the light emitting elements, at least one imaging optical system that images light from the light emitting elements, and a control section that supplies the line head with image data. The light emitting elements form n (n is an integral number equal to or greater than 2) light emitting element rows in a rotational direction of the photoconductor drum, and the drive circuits are electrically connected with the wirings to light emitting elements belonging to a number of light emitting element rows equal to or smaller than n−1.

According to still another aspect of the invention, in the image forming device described above, the imaging optical system has negative optical power.

According to still another aspect of the invention, in the image forming device described above, the control section reverses the image data in an axial direction and the rotational direction of the photoconductor drum to reorder the image data.

According to still another aspect of the invention, in the image forming device described above, the control section executes reordering of the image data in accordance with a configuration of the wirings electrically connecting the drive circuits and the light emitting elements.

According to still another aspect of the invention, in the image forming device described above, the drive circuits are disposed on one side of the substrate in the rotational direction of the photoconductor drum.

According to still another aspect of the invention, in the image forming device described above, the drive circuits are disposed on both sides of the substrate in the rotational direction of the photoconductor drum.

According to still another aspect of the invention, in the image forming device described above, there is further included flexible printed circuit boards electrically connected to the wirings, and the drive circuits are disposed on the flexible printed circuit boards.

According to still another aspect of the invention, in the image forming device described above, the flexible printed circuit boards are disposed on both sides of the substrate in the rotational direction of the photoconductor drum.

According to still another aspect of the invention, in the image forming device described above, the number of flexible printed circuit boards disposed on one side of the substrate in the rotational direction of the photoconductor drum and the number of flexible printed circuit boards disposed on the other side of the substrate are different from each other.

BRIEF DESCRIPTION OF THE DRAWINGS

The invention will now be described with reference to the accompanying drawings, wherein like numbers reference like elements.

DESCRIPTION OF EXEMPLARY EMBODIMENTS

Figure 3:
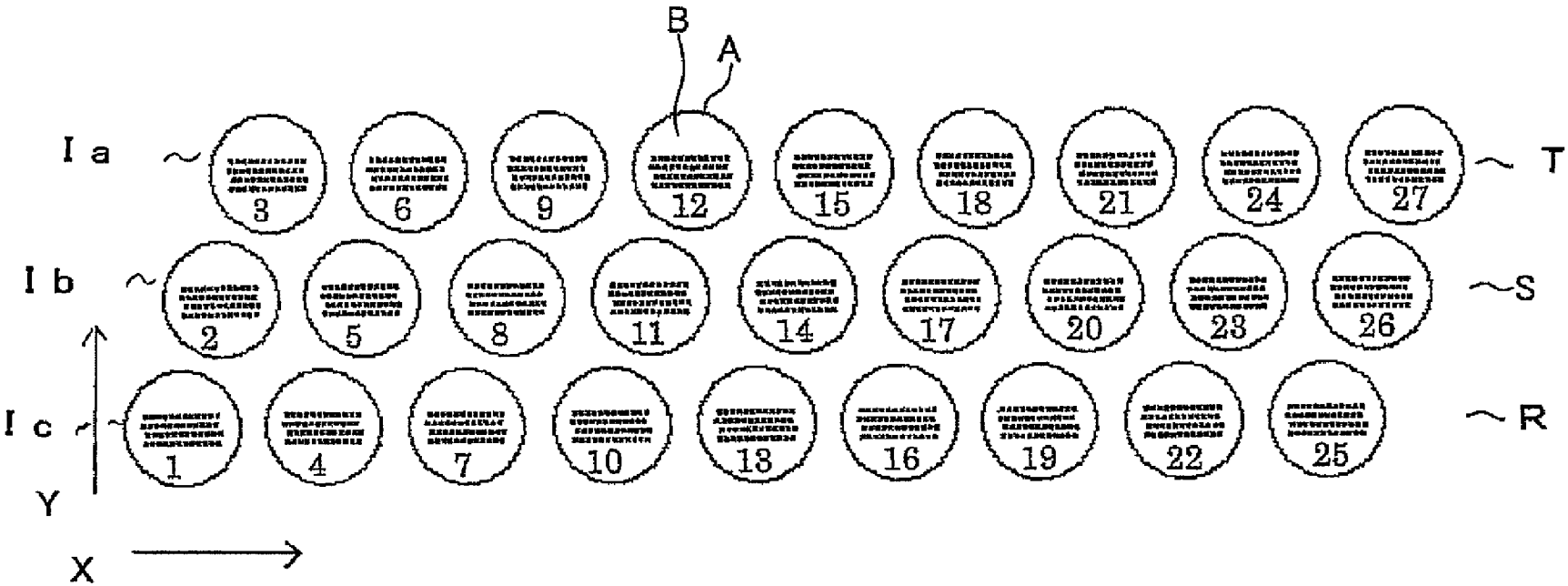
FIG. 3 is an explanatory diagram of a line head according to an embodiment of the invention.

FIG. 3 is a schematic explanatory diagram showing an example of a line head according to an embodiment of the invention. In FIG. 3, A denotes an imaging lens with negative optical power, and B denotes a light emitting element group composed of a plurality of light emitting elements disposed inside the imaging lens A. The light emitting elements emit light towards the viewer of the sheet of FIG. 3. A plurality of imaging lenses A are disposed in the axial direction (the X or main-scanning direction) and in the rotational direction (the Y or sub-scanning direction) of the photoconductor drum. A plurality of light emitting element groups B disposed in the imaging lenses A is disposed in the X and Y directions in this example.

As described above, the imaging lenses A are arranged in the X and Y directions to form imaging lens rows R, S and T. The imaging lens rows also correspond to light emitting element rows. Therefore, light emitting element group rows R, S and T are formed. The light emitting element group rows are represented as light emitting element rows Ia, Ib and Ic when viewed along the axial direction of the photoconductor drum. In FIG. 3, the light emitting element rows Ia-Ic are disposed in three rows in the axial direction of the photoconductor drum.

The imaging lens row R is disposed on the upstream side in the rotational (Y) direction of the photoconductor drum, and the imaging lens row T is disposed on the downstream side in the rotational (Y) direction. The imaging lenses A are individually denoted with the numbers 1-27. In FIG. 3, the imaging lens rows R, S and T are disposed in three rows arranged in the Y direction so as to form a zigzag arrangement in which the disposition positions of the imaging lens rows R, S and T are shifted in the X direction from each other.

Figure 4:
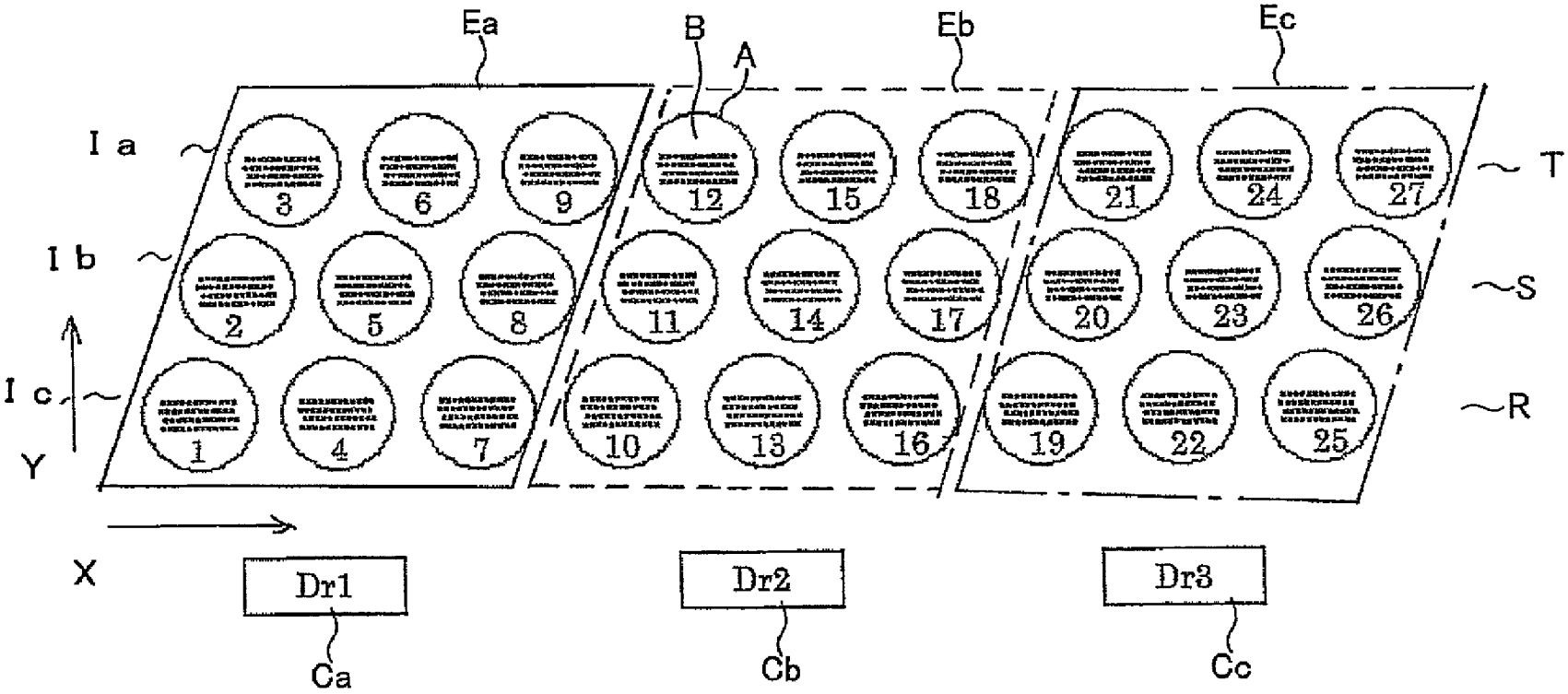
FIG. 4 is a reference diagram showing correspondence between light emitting elements arranged as in FIG. 3 and drive circuits for driving the light emitting elements according to the invention.
Figure 5:
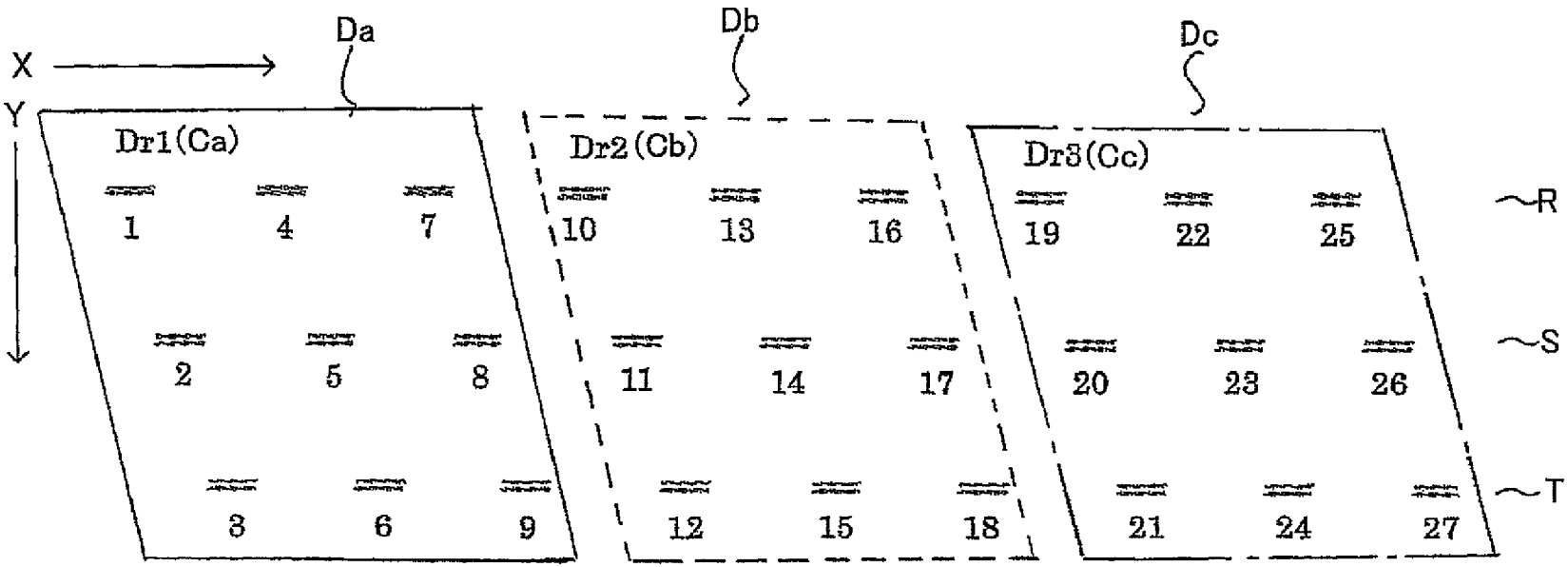
FIG. 5 is a reference diagram showing image data to be supplied to driver ICs according to the invention.
Figure 6:
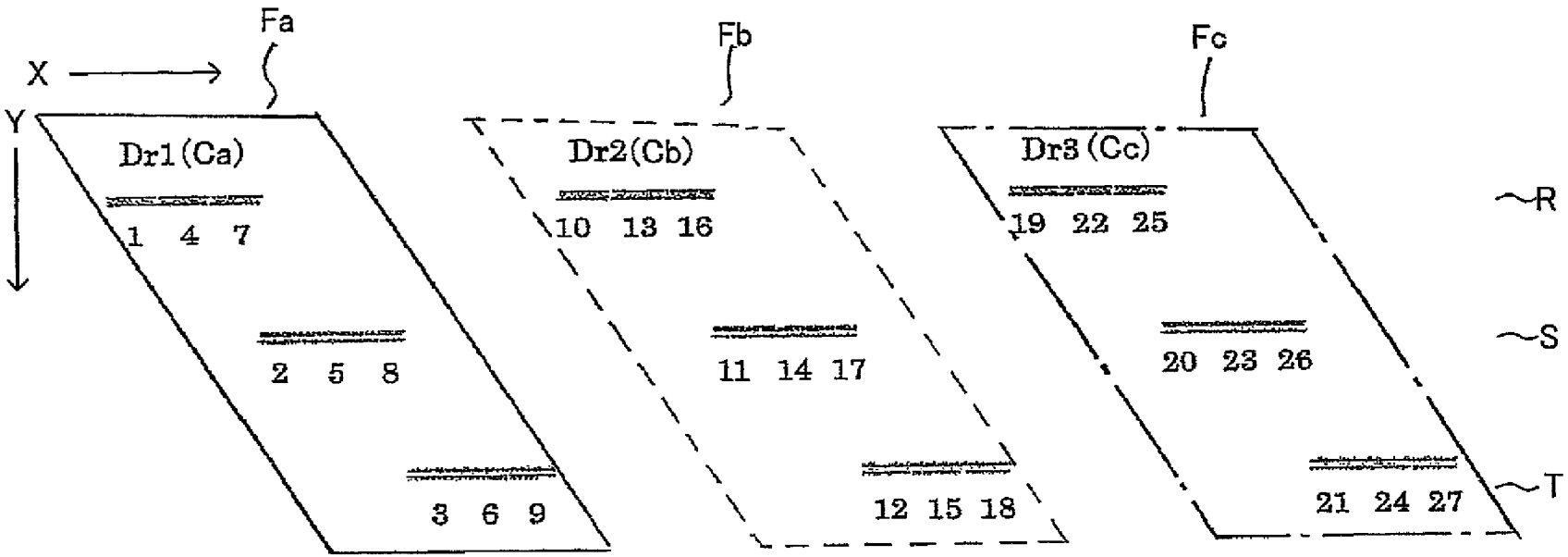
FIG. 6 is a reference diagram showing a different wiring connection according to the invention.

FIGS. 4-6 are reference diagrams showing a prerequisite technology of the invention. FIG. 4 is a reference diagram showing the correspondence between the light emitting elements arranged as shown in FIG. 3 and drive circuits for driving the light emitting elements. The light emitting elements are connected with wiring to driver ICs Ca, Cb and Cc forming the drive circuit. The wiring transmits drive signals from the driver ICs to the light emitting elements. The symbols Ea, Eb and Ec denote the areas of the light emitting elements driven by the driver ICs.

The driver IC Ca drives the light emitting elements in the area Ea, the driver IC Cb drives the light emitting elements in the area Eb, and the driver IC Cc drives the light emitting elements in the area Ec. In other words, the driver IC Ca drives the light emitting elements corresponding to the imaging lenses 1-9, the driver IC Cb drives the light emitting elements corresponding to the imaging lenses 10-18, and the driver IC Cc drives the light emitting elements corresponding to the imaging lenses 19-27.

The area of raster data in the X (main-scanning) direction is divided into areas corresponding to the driver ICs for the sake of convenience of the wiring connection between the light emitting elements and the corresponding driver IC, and because the driver ICs must be provided with continuous image data from the control circuit. Since the drive circuit is divided into three light emitting element group rows in the Y direction, and the divisional drive circuits are connected to light emitting elements in the areas Ea, Eb and Ec obtained by dividing the light emitting element group rows via the wiring, the number of light emitting elements connected to the same divisional drive circuit is reduced, and the wiring connection treatment can smoothly be executed.

In FIGS. 3 and 4, microlenses with negative optical power are used as the imaging lenses A. Therefore, in order to form the same latent image on the photoconductor drum as the original image, the drive signals for the light emitting elements supplied to the driver ICs need to correspond to the image data reversed in the X and Y directions for each light emitting element group. Further, reordering of the data in the X and Y directions must be executed in accordance with the order of the wiring connections between the driver ICs and the light emitting element groups, and the pitches of the light emitting elements and the imaging lenses.

FIG. 5 is a reference diagram schematically showing the image data to be supplied to the driver ICs. In FIG. 5, the numbers 1-27 correspond to the imaging lenses 1-27 of FIGS. 3 and 4. Here, the supply of image data to each of the light emitting elements disposed in correspondence with each of the imaging lenses is shown. Specifically, as shown in FIGS. 3 and 4, the light emitting elements corresponding to the imaging lenses 1-9 and driven by the driver IC Ca correspond to the imaging lenses 1, 4 and 7 in the imaging lens row R, to the imaging lenses 2, 5 and 8 in the imaging lens row S, and to the imaging lenses 3, 6 and 9 in the imaging lens row T.

In this manner, the imaging lenses are arranged in the order of "1, 4, 7," "2, 5, 8," and "3, 6, 9" when viewed from the upstream side in the rotational (Y) direction of the photoconductor drum. Further, the light emitting elements and the light emitting element groups are arranged along the Y direction with a constant pitch, and data corresponding to the light emitting elements is arranged in the Y direction with a constant distance corresponding to the pitch.

The wiring connection order between the driver IC Ca and the light emitting elements corresponding to the imaging lenses 1-9 is now explained. In FIGS. 3 and 4, the wiring connection is made in the order of imaging lenses 1, 2, 3, 4, 5, 6, 7, 8 and 9. Further, since the data of "0" must be input to light emitting elements in the imaging lenses that do not emit light, the data for the R row is supplied with the "0" data at the portions of the data corresponding to the imaging lenses 2, 3, 5, 6, 8 and 9.

Therefore, as shown in FIG. 5, in the range Da of reordering of the image data supplied to the light emitting elements driven by the driver IC Ca, the data corresponding to each of the light emitting element groups is reversed in the X and Y directions, and further, reordered in the Y direction in accordance with the pitch of the light emitting element group rows, and the light emitting elements of the corresponding light emitting element groups are supplied with the image data in the order of the imaging lenses 1, 2, 3, 4, 5, 6, 7, 8 and 9. Regarding the ranges Db, Dc of reordering of the image data supplied to the light emitting elements driven by the driver ICs Cb and Cc, respectively, the reordering of the image data to be supplied to the light emitting elements of the light emitting element group rows is executed in substantially the same manner.

However, when the imaging lenses are arranged in a plurality of rows arranged in the Y direction, the order of the wiring connections becomes different in accordance with a design specification of the control circuit such as supply sequence of the image data and the form of wiring connection between the drive circuit and the light emitting elements. In other words, there are some cases in which the order of the wiring connections with the light emitting elements corresponding to the respective imaging lenses is different from that shown in FIGS. 3 and 4.

FIG. 6 is a reference diagram showing such a case of a different wiring connection. FIG. 6 shows the range Fa in which image data is reordered in a case in which the order of the wiring connections between the driver IC Ca and the light emitting elements corresponding to the imaging lenses 1-9 is 1, 4, 7, 2, 5, 8, 3, 6 and 9. In this case, since the data to the light emitting elements corresponding to the imaging lenses 1, 4 and 7; 2, 5 and 8; and 3, 6 and 9 are each continuous data, the data of the light emitting element group corresponding to the image lenses 1, 4 and 7 on the upstream side in the Y direction is moved over to the left to eliminate spaces therebetween, and is supplied with 0 at the portions corresponding to the imaging lenses 2, 5, 8, 3, 6 and 9.

Further, the image data to the light emitting elements corresponding to the imaging lenses 3, 6 and 9 on the downstream side in the Y direction is moved over to the right to eliminate spaces therebetween, and is supplied with 0 at the portions corresponding to the imaging lenses 1, 4, 7, 2, 5 and 8. The image data to the light emitting elements corresponding to the imaging lenses 2, 5 and 8 on the middle in the Y direction is moved over to the center to eliminate spaces therebetween, and is supplied with 0 at the portions corresponding to the imaging lenses 1, 4, 7, 3, 6 and 9. Regarding the driver ICs Cb and Cc, the ranges Fb and Fc in which the reordering of the image data to be supplied to the light emitting elements is executed are set in substantially the same manner.

In FIGS. 3-6, the driver ICs drive all of the light emitting elements corresponding to the plurality of imaging lens rows (light emitting element group rows) arranged in the Y direction. However, in a line head provided with a number of light emitting elements arranged in the X and Y directions, since the wiring connection space for making wiring connections between the driver ICs and the light emitting elements is limited, the wiring connection treatment is troublesome, and the length of the wiring becomes longer. Therefore, a rational device for reducing the number of light emitting elements connected to the driver IC is needed.

Figure 1:
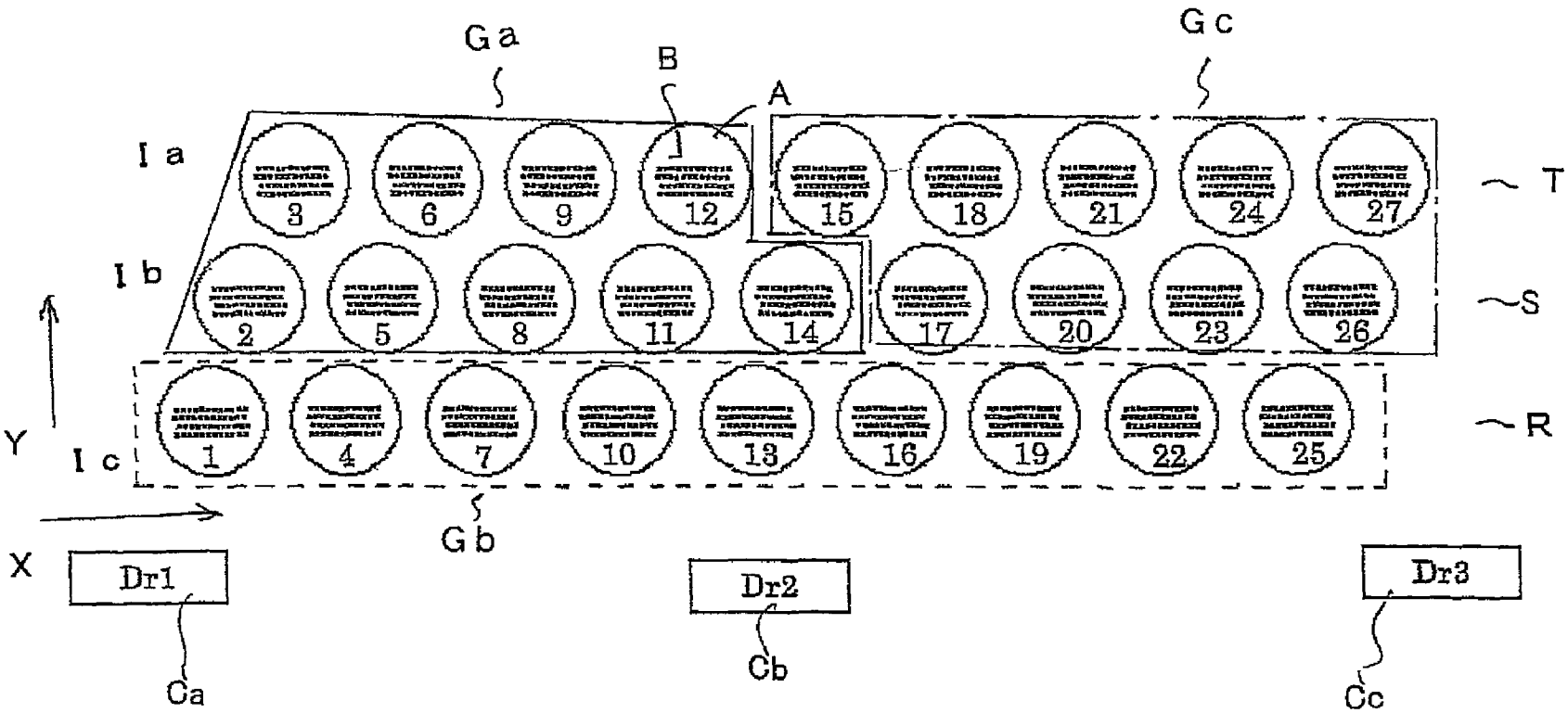
FIG. 1 is an explanatory diagram showing an embodiment of the invention.
Figure 2:
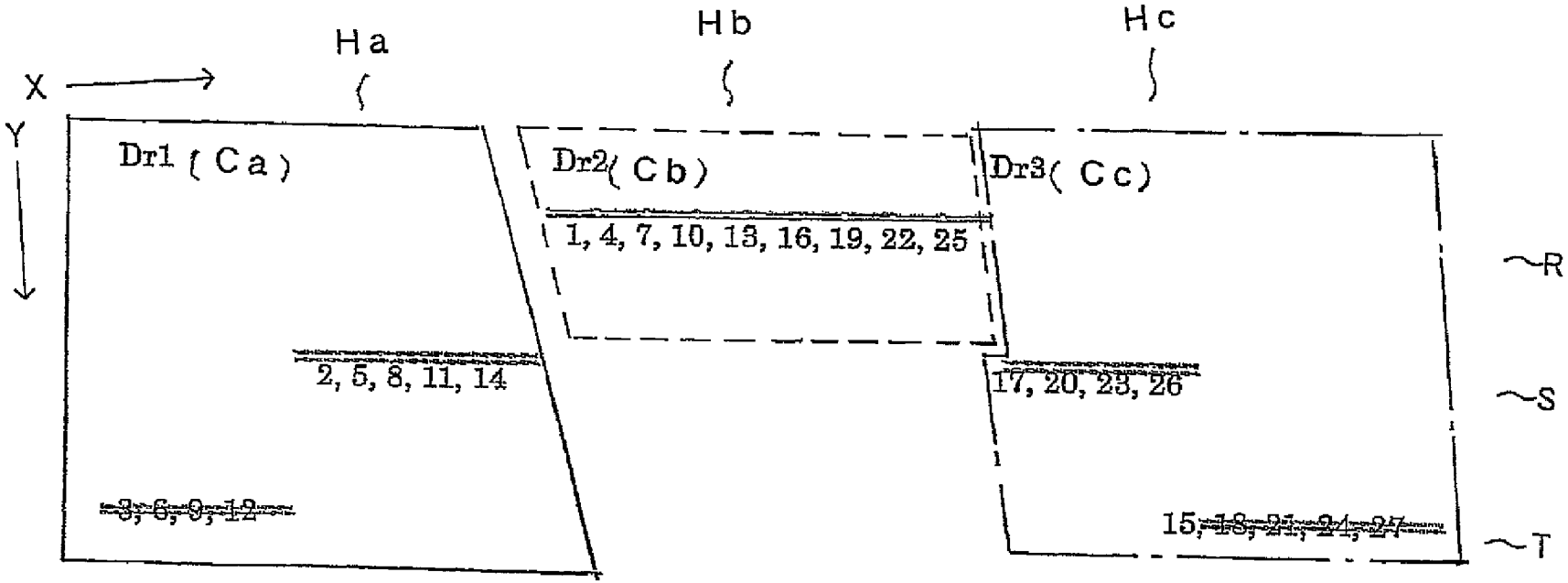
FIG. 2 is an explanatory diagram showing an embodiment of the invention.

FIGS. 1 and 2 are explanatory diagrams showing an embodiment of the invention provided with such a device. In FIG. 1, the driver IC Ca drives the light emitting elements corresponding to the imaging lenses 3, 6, 9 and 12; and the imaging lenses 2, 5, 8, 11 and 14, namely, the light emitting elements in the section Ga. In this example, the light emitting elements in the light emitting element group row corresponding to the imaging lenses on the downstream side in the Y direction and the light emitting elements of the light emitting element group row corresponding to the imaging lenses on the middle in the Y direction are driven, and the light emitting elements of the light emitting element group row corresponding to the imaging lenses on the upstream side in the Y direction are not driven.

Therefore, the driver IC Ca drives the light emitting elements corresponding to the imaging lenses on the rows on the downstream side and the middle in the Y direction, and is not connected via wiring to the light emitting elements corresponding to the imaging lenses on the row on the upstream side. Therefore, a margin is generated in the wiring connection space, and the wiring connection treatment can smoothly be executed.

The driver IC Cb drives the light emitting elements corresponding to the imaging lenses 1, 4, 7, 10, 13, 16, 19, 22 and 25, namely, the light emitting elements in the section Gb. The driver IC Cb drives only the light emitting elements of the light emitting element group row disposed on the upstream side in the Y direction. A larger margin is thereby generated in wiring connection space than in the case with the driver IC Ca.

The driver IC Cc drives the light emitting elements corresponding to the imaging lenses 17, 20, 23 and 26; and 15, 18, 21, 24 and 27, namely, the light emitting elements in the section Gc. In this case, similarly to driver IC Ca, the driver IC Cc drives the light emitting elements of the light emitting element group rows on the downstream side and on the middle in the Y direction, and is not connected via wiring to the light emitting elements of the light emitting element group row on the upstream side.

FIG. 2 shows the range Ha of the reordering of the image data in the configuration of FIG. 1. The image data to the light emitting elements, which are driven by the driver IC Ca, and belong to the light emitting element group row corresponding to the imaging lenses 3, 6, 9 and 12 on the downstream side in the Y direction, are reordered to the area on the downstream side in the Y direction and to the left. The image data to the light emitting elements of the light emitting element group row corresponding to the imaging lenses 2, 5, 8, 11 and 14 on the middle in the Y direction is reordered to the area on the middle and to the right.

The image data to the light emitting elements of the light emitting element group row corresponding to the imaging lenses 1, 4, 7, 10, 13, 16, 19, 22 and 25 on the upstream side in the Y direction is reordered to the area on the upstream side in the Y direction, and have the range Hb of the reordering of the image data. The image data to the light emitting elements, which are driven by the driver IC Cc, and belong to the light emitting element group row corresponding to the imaging lenses 15, 18, 21, 24 and 27 on the downstream side in the Y direction, are reordered to the area on the downstream side in the Y direction. No reordering is executed on the image data to the light emitting elements of the light emitting element group row corresponding to the imaging lenses 17, 20, 23 and 26 on the middle in the Y direction. Thus, the range Hc of the reordering of the image data is obtained.

Figure 8:
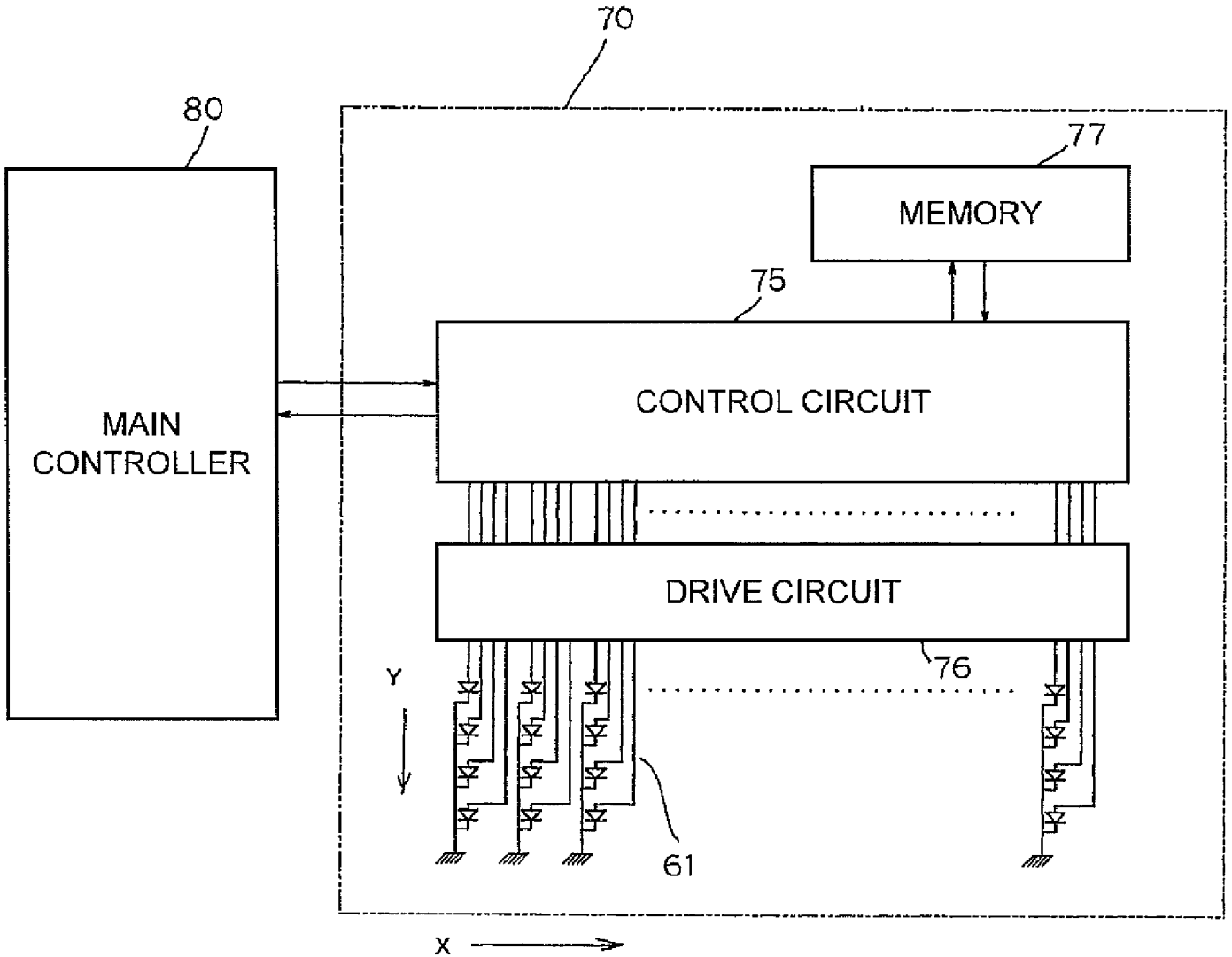
FIG. 8 is a block diagram showing a control section.

The processing of the reordering of the image data is executed by the control circuit 75 in the block diagram of FIG. 8. The image data obtained by the reordering processing is stored in the memory 77. In other words, the memory 77 is provided with an area for storing the original image data and an area for storing the image data obtained by the reordering processing. In the case in which reordering of the image data in the X direction is necessary, the image data on which reordering processing in the X direction has been executed by the main controller 80 is transmitted to the control circuit 75. Alternatively, the control circuit 75 may execute reordering processing of the image data in the X direction on the original image data stored in the memory 77.

In FIGS. 1 and 2, a configuration is adopted in which a light emitting element substrate having n (n=3 in the example) light emitting element rows obtained by grouping a plurality of light emitting elements in the rotational direction of the photoconductor drum, and the driver ICs for driving the light emitting elements are provided, and one of the driver ICs is connected to the light emitting elements of a number of light emitting element rows equal to or smaller than n−1 (n−1>1, 2 in the example).

As explained with reference to FIG. 3, in a line head having a number of light emitting elements and a number of imaging lenses disposed in the X (main-scanning) direction and the Y (sub-scanning) direction, a normal latent image cannot be obtained only by reordering the image data taking into consideration the pitch and number of light emitting elements in the X direction, the number of light emitting element group rows in the Y direction, the pitch and number of imaging lenses in the X direction, and the number of imaging lenses in the Y direction. In the embodiment of the invention, since the reordering of the image data is executed taking the form of the wiring connection of the light emitting elements controlled by the driver IC into consideration, a normal latent image can be formed on the photoconductor drum.

In the embodiment of the invention, the reordering correction of the image data is executed in the case in which the microlens array (MLA) is arranged in a zigzag manner as shown in FIG. 3 using the wiring connection rule between the driver IC and the light emitting elements as one of the parameters. By executing such reordering correction of the image data, it becomes possible to generate the image data to the line head having a different wiring connection rule between the driver IC and the light emitting elements. Thus, the image data generation block for line head control can be made general-purpose, and the manpower for regenerating the image data generation logic associated with changes to the specification of the line head can be reduced.

Figure 7:
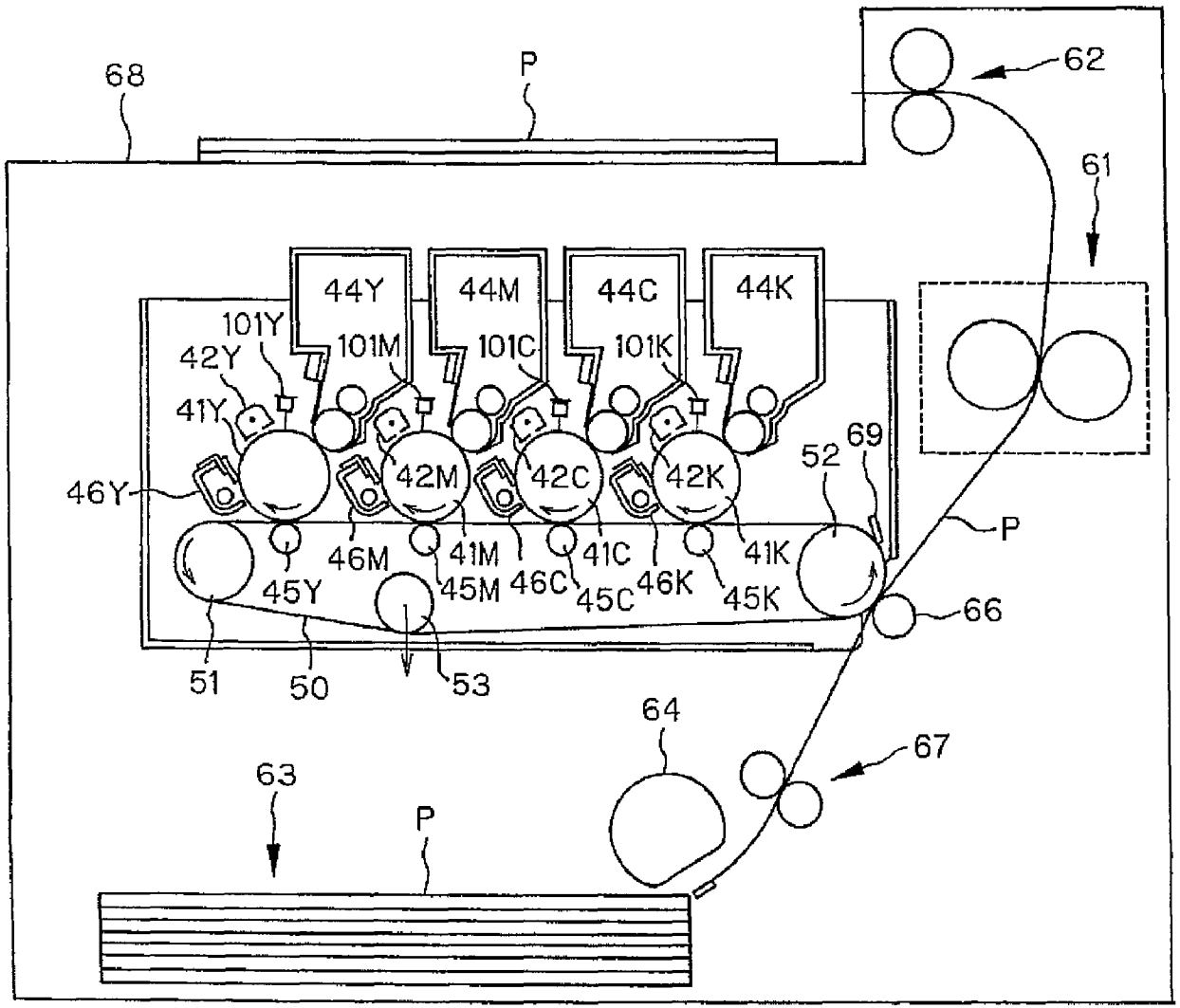
FIG. 7 is a schematic cross-sectional view showing an overall configuration of an example of an image forming device using an electrophotographic process according to an embodiment of the invention.

In the embodiment of the invention, a line head used for a tandem type color printer (image forming device), which exposes four photoconductor drums with four line heads, forms an image with four colors at one time, and transfers it to one endless intermediate transfer belt (intermediate transfer medium), is intended. FIG. 7 is a vertical cross-sectional side view showing an example of a tandem type image forming device using organic EL elements as light emitting elements. This image forming device includes four light emitter arrays (line heads) 101K, 101C, 101M and 101Y each having substantially the same configuration and disposed at a position for exposing respective one of four photoconductor drums (image carrying members) 41K, 41C, 41M and 41Y each having substantially the same configuration, and is configured as a tandem image forming device.

As shown in FIG. 7, the image forming device includes a drive roller 51, a driven roller 52, a tension roller 53, and an intermediate transfer belt (intermediate transfer medium) 50 stretched across the rollers, tensioned by the tension roller 53 and circulated in the direction of the arrows (counterclockwise). The photoconductor drums 41K, 41C, 41M and 41Y each have a photoconductor drum layer on its outer periphery and are disposed along the intermediate transfer belt 50 at predetermined intervals as the four image carrying members.

The letters K, C, M and Y added to reference numerals herein denote that the designated members are dedicated to the colors black, cyan, magenta and yellow, respectively. The photoconductor drums 41K, 41C, 41M, and 41Y are rotationally driven in the direction of the arrows (clockwise) shown in the drawing in sync with driving of the intermediate transfer belt 50. Around the photoconductor drums 41 (K, C, M, Y), there are provided charging members (corona chargers) 42 (K, C, M, Y) for evenly charging the outer peripheral surfaces of the photoconductor drums 41 (K, C, M, Y), and the light emitter arrays (the line heads) 101 (K, C, M, Y) according to the embodiment of the invention as described above for sequentially line-scanning the outer peripheral surfaces evenly charged by the charging members 42 (K, C, M, Y) in sync with the rotation of the photoconductor drums 41 (K, C, M, Y).

Further, there are provided developing devices 44 (K, C, M, Y) for providing toner as developers to the electrostatic latent image formed by the light emitter arrays (line heads) 101 (K, C, M, Y) to form visible images (toner images), primary transfer rollers 45 (K, C, M, Y) as transfer sections for sequentially transferring the toner images developed by the developing devices 44 (K, C, M, Y) to the intermediate transfer belt 50 as the primary transfer object, and cleaning devices 46 (K, C, M, Y) as cleaning members for removing toner remaining on the surfaces of the photoconductor drums 41 (K, C, M, Y) after the transfer process.

The array direction of the light emitter arrays (exposure heads) 101 (K, C, M, Y) is parallel to the generating lines of the photoconductor drums 41 (K, C, M, Y). Further, the peak emission energy wavelengths of the light emitter arrays (line heads) 101 (K, C, M, Y) are substantially equal to the peak sensitivity wavelengths of the photoconductor drums 41 (K, C, M, Y).

The developing devices 44 (K, C, M, Y) use, for example, non-magnetic monocomponent toner as the developers, feed the monocomponent developers to developing rollers by, for example, supply rollers, limit the thicknesses of the developers adhered to the surfaces of the developing rollers by limiting blades, contact or press the developing rollers to or against the photoconductor drums 41 (K, C, M, Y) to provide the developers to the photoconductor drums 41 (K, C, M, Y) in accordance with the electrical potential levels thereof, thereby developing the toner images.

Each of the four toner images of black, cyan, magenta, and yellow formed by the monochromatic toner image forming station is sequentially primary-transferred on the intermediate transfer belt 50 in accordance with the primary transfer bias applied to the primary transfer rollers 45 (K, C, M, Y). The full color toner image formed by sequentially stacking the four toner images of respective colors on the intermediate transfer belt 50 is then secondary-transferred to a recording medium P such as a paper sheet in a secondary-transfer roller 66, and then fixed on the recording medium P by passing through a fixing roller pair 61 as a fixing section, and then discharged on a paper receiving tray 68 provided to the top section of the device by a paper discharge roller pair 62.

In FIG. 7, the reference numeral 63 denotes a paper feed cassette in which a number of sheets of recording media P are stacked and held, the reference numeral 64 denotes a pick-up roller for feeding the recording medium P sheet by sheet from the paper feed cassette 63, the reference numeral 67 denotes a gate roller pair for defining feed timing of the recording medium P to the secondary-transfer section of the secondary-transfer roller 66, the reference numeral 69 denotes a cleaning blade as a cleaning member for removing toner remaining on the surface of the intermediate transfer belt 50 after the secondary-transfer process.

In an exposure device using a line head (e.g., an organic EL print head (OPH)) having light emitting elements such as organic EL light emitting elements arranged two-dimensionally on a substrate and a microlens array (MLA) with negative optical power as imaging lenses, the plurality of light emitting elements disposed in each of the imaging lenses are made to emit light sequentially from the light emitting element disposed on the downstream side in the sub-scanning (Y) direction, namely in the rotational direction of the photoconductor drum. Further, by making the light emitting elements on each of the imaging lenses sequentially from the light emitting element disposed on the upstream side in the rotational direction of the photoconductor drum, a one-dimensional latent image is formed on the image carrying member.

Figure 9:
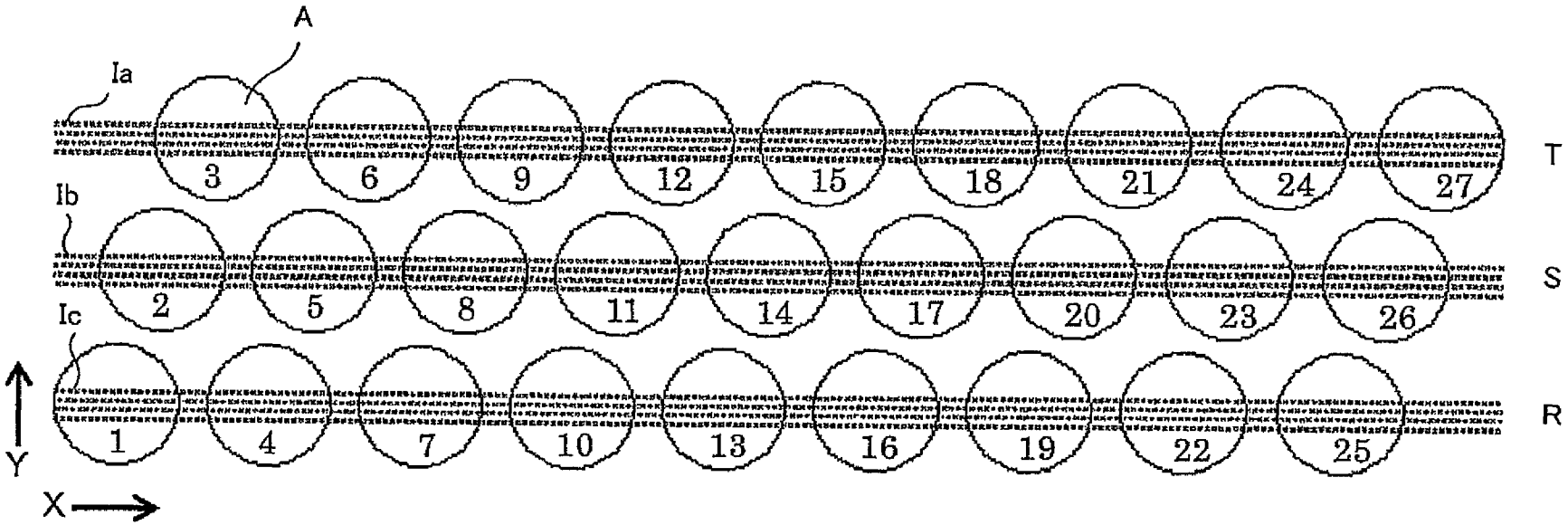
FIG. 9 is an explanatory diagram showing an example of arranging light emitting elements of a line head two-dimensionally according to an embodiment of the invention.

FIG. 9 is an explanatory diagram showing an example of arranging the light emitting elements of the line head two-dimensionally in order to realize a high-resolution line head. Although in the example shown in FIG. 3, a plurality of light emitting elements B are arranged in the longitudinal (X) direction of the substrate to be separated for each of the imaging lenses A, in the example shown in FIG. 9, the light emitting element rows Ia-Ic are arranged beyond the range of the imaging lenses A in the longitudinal direction of the substrate. The numbers 1-27 in the imaging lenses of FIG. 9 correspond to the arrangement of the reordering data described later.

Figure 10:
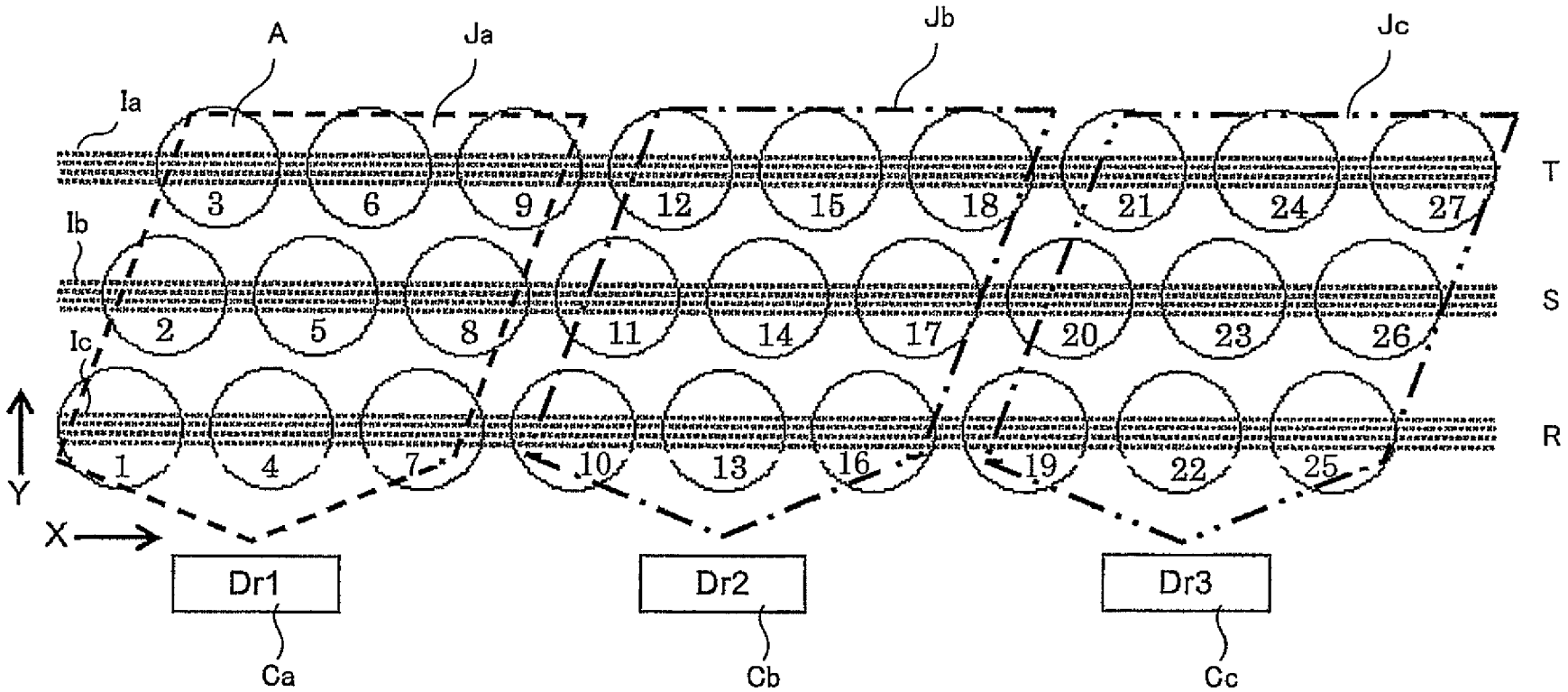
FIG. 10 is an explanatory diagrams showing correspondence between driver ICs and imaging lenses in an exposure device of an embodiment of the invention.
Figure 11:
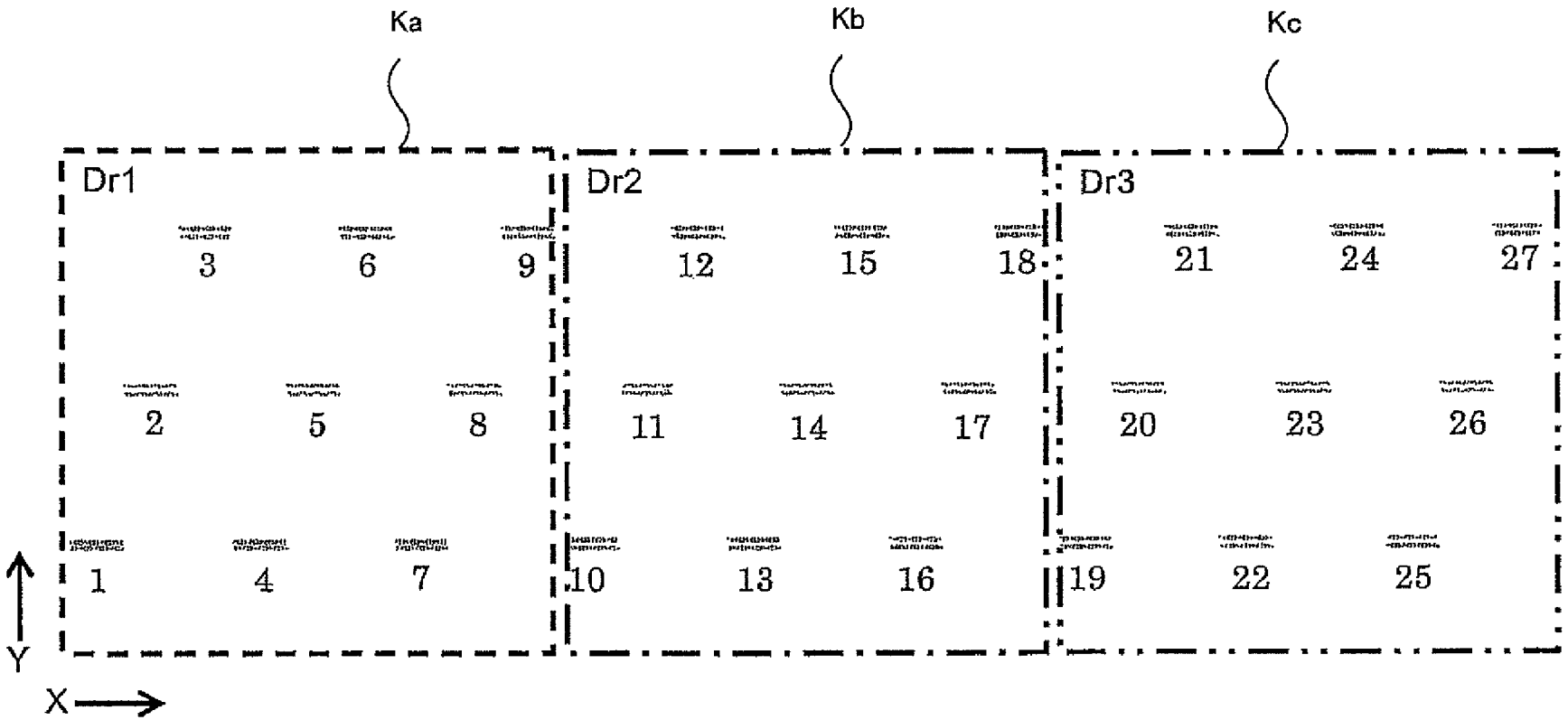
FIG. 11 is an explanatory diagrams showing an example of reordering of image data using the wiring of FIG. 10 according to an embodiment of the invention.
Figure 12:
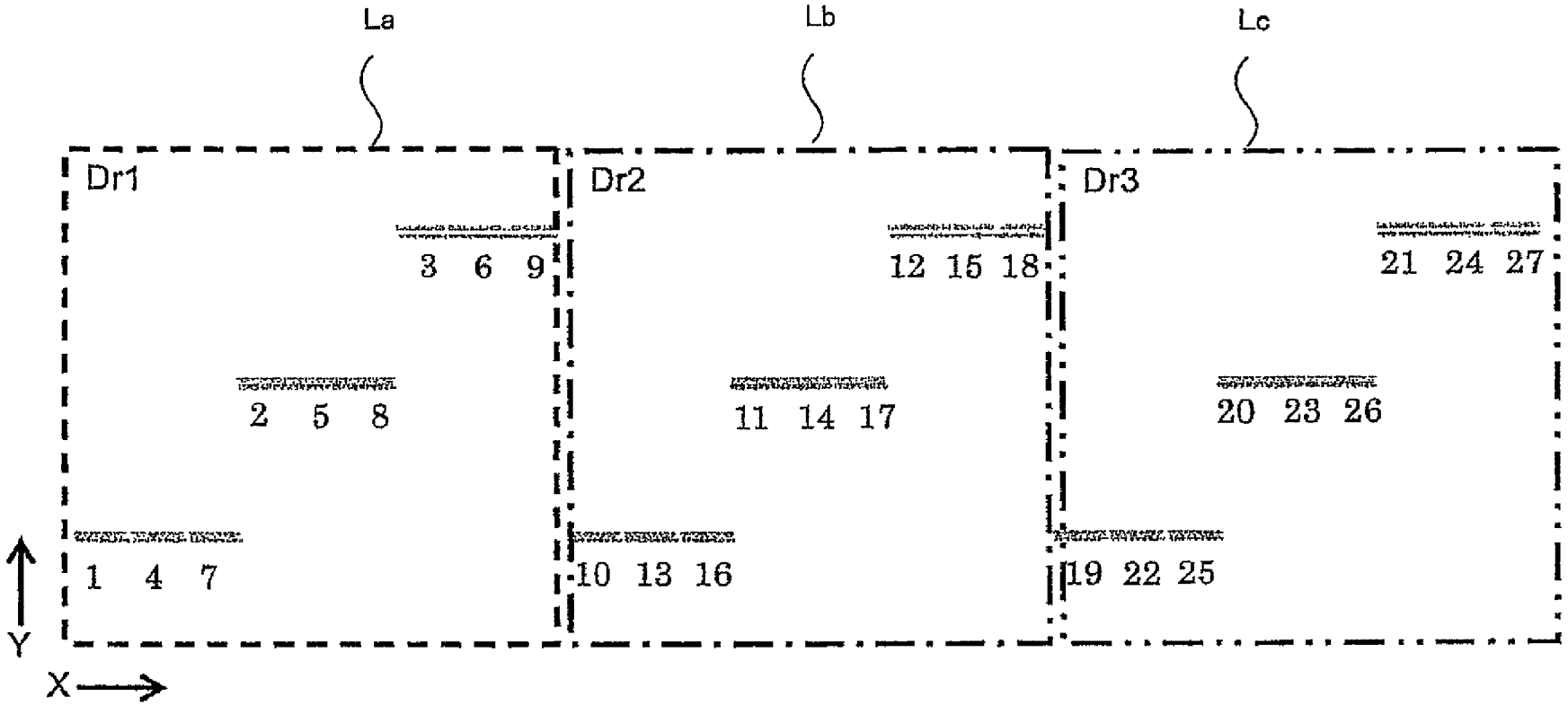
FIG. 12 is an explanatory diagrams showing another example of reordering of image data according to an embodiment of the invention.

FIGS. 10-12 are explanatory diagrams showing a prerequisite technology of the invention. FIG. 10 is an explanatory diagram showing correspondence between driver ICs for controlling and imaging lenses including light emitting element groups to be controlled in an exposure device using the MLA and the OPH in combination. FIG. 10 shows the sections controlled by the three driver ICs Dr1 (Ca), Dr2 (Cb), and Dr3 (Cc) by surrounding the imaging lenses corresponding to the light emitting elements controlled by the respective driver ICs with the dot line (Ja), the dashed line (Jb), and the double dashed line (Jc), respectively. The driver IC Dr1 controls the light emitting elements corresponding to the imaging lenses 1, 2, 3, 4, 5, 6, 7, 8 and 9, the driver IC Dr2 controls the light emitting elements corresponding to the imaging lenses 10, 11, 12, 13, 14, 15, 16, 17 and 18, and the driver IC Dr3 controls the light emitting elements corresponding to the imaging lenses 19, 20, 21, 22, 23, 24, 25, 26 and 27

The light emitting element control by the driver ICs has different forms in accordance with the design of the line head and the wiring form between the driver ICs and the light emitting elements. For example, in FIG. 10, in the case of the driver IC Dr1, it is possible to adopt the form of wiring the driver IC Dr1 with the light emitting elements corresponding to the imaging lenses in the order of the imaging lenses 1, 2, 3, 4, 5, 6, 7, 8 and 9 as described above. Further, it is possible to adopt the form of wiring the driver IC Dr1 with the light emitting elements corresponding to the imaging lenses in the order of the imaging lenses 1, 4, 7, 2, 5, 8, 3, 6 and 9.

FIG. 11 is an explanatory diagram showing an example of the reordering of the image data in the case of providing the wiring shown in FIG. 10 and using the MLA as the imaging lenses. In FIG. 11, in the case of wiring the driver IC Dr1 with the light emitting elements corresponding to the imaging lenses in the order of the imaging lenses 1, 2, 3, 4, 5, 6, 7, 8 and 9 as described above, the image data arrangement shown in the range Ka is adopted. In this case, since the imaging lenses have negative optical power, the image data output from the light emitting elements are reversed in the Y and X directions, thus a linear latent image formed of the image data 1-9 is formed on the photoconductor drum. The image data arrangement for the driver IC Dr2 is shown in the range Kb, and the image data arrangement for the driver IC Dr3 is shown in the range Kc.

FIG. 12 is an explanatory diagram showing another example of the reordering of the image data. FIG. 12 shows an example of wiring the driver IC Dr1 with the light emitting elements corresponding to the imaging lenses in the order of the imaging lenses 1, 4, 7, 2, 5, 8, 3, 6 and 9. In this example, the reordering of the image data corresponding the light emitting elements wired with the driver IC Dr1 is shown in the range La. The image data arrangement for the driver IC Dr2 is shown in the range Lb, and the image data arrangement for the driver IC Dr3 is shown in the range Lc.

Figure 13:
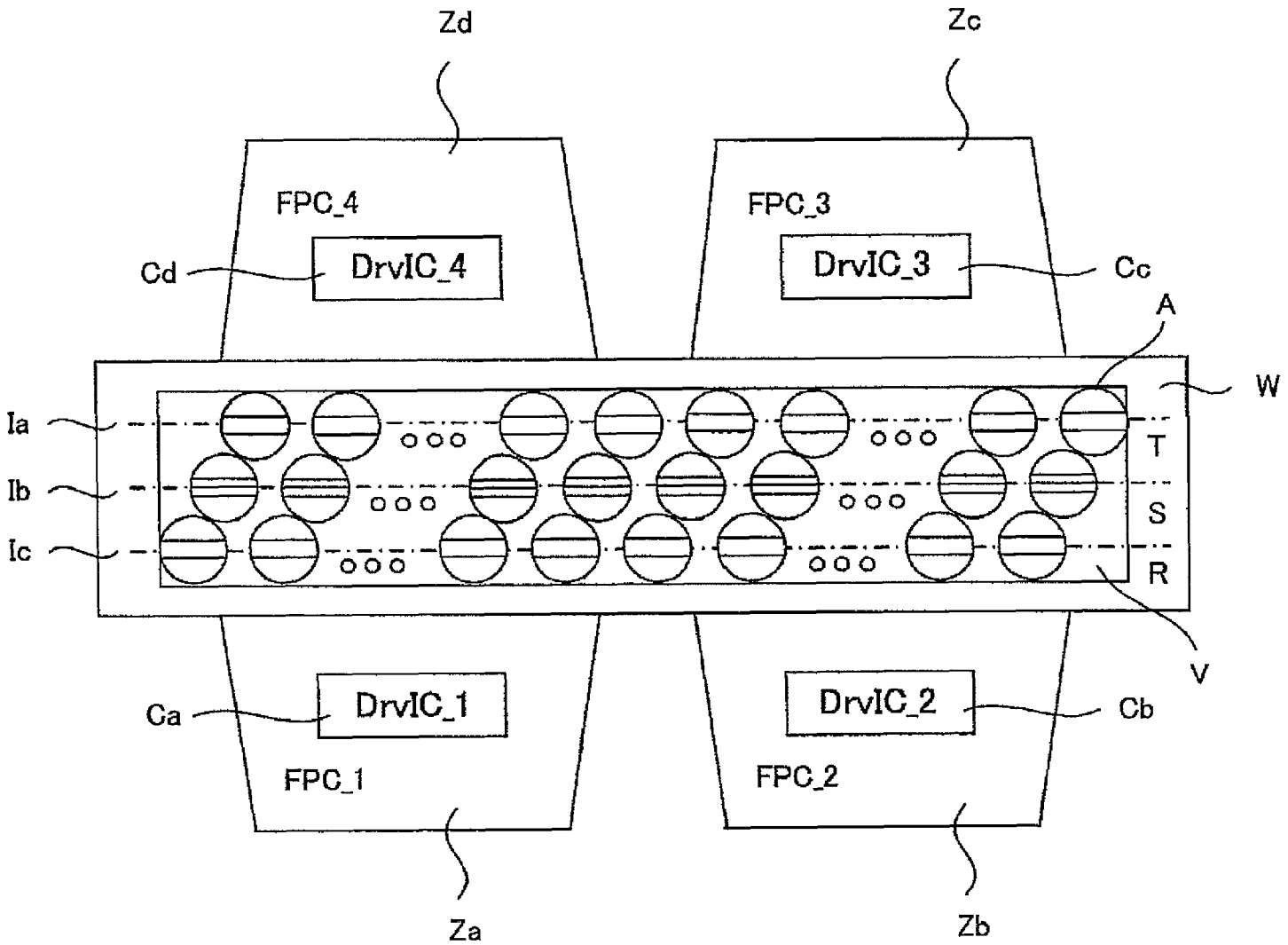
FIG. 13 is an explanatory diagram showing an arrangement relationship between light emitting elements and driver ICs according to an embodiment of the invention.

FIG. 13 is an explanatory diagram showing an arrangement relationship between the light emitting elements and the driver ICs Dr1 through Dr4 in a case in which a plurality of light emitting elements is arranged in the longitudinal direction (axial direction of the photoconductor drum) and the width direction (rotational direction of the photoconductor drum) of the substrate W. In FIG. 13, V denotes an organic EL print head (OPH, i.e., a line head according to an embodiment of the invention) panel mounted on the substrate W, and provided with the light emitting element rows Ia, Ib and Ic composed of a plurality of light emitting elements formed along the longitudinal direction thereof. Each of the light emitting element rows Ia-Ic is provided with a plurality of rows of the light emitting elements arranged in the rotational direction of the photoconductor drum.

On both sides of the OPH panel V, namely on the upstream and downstream sides thereof in the rotational direction of the photoconductor drum, flexible printed circuits (FPC) Za-Zd are connected thereto. Driver ICs DrvIC_1-DrvIC_4 (Ca-Cd) are mounted on FPCs Za-Zd. In FIG. 13, on both the upstream and downstream sides of the OPH panel V, there are two FPCs connected to the OPH panel V so that the two FPCs on the one side are positioned symmetrically to the two FPCs on the other side thereof.

Figure 14:
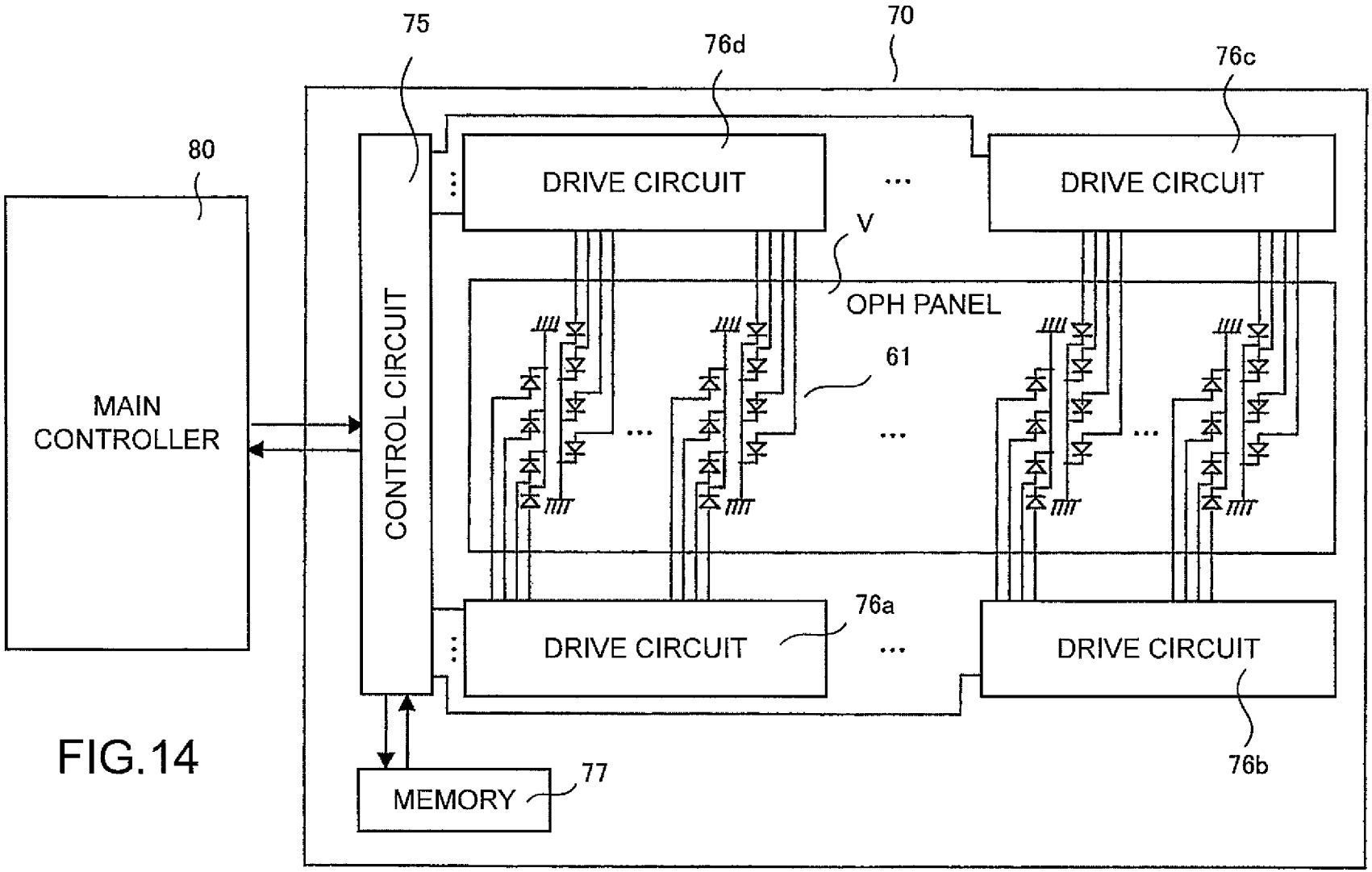
FIG. 14 is a block diagram of a control section according to an embodiment of the invention.

FIG. 14 is a block diagram of the control section 70. As explained with reference to FIG. 8, the reference numeral 80 denotes a main controller to be connected to the control section 70 of the line head. The reference numeral 75 denotes a control circuit, the reference numeral 76 denotes a drive circuit, the reference numeral 77 denotes a memory, the reference numeral 61 denotes light emitting elements for which organic EL elements are used, and a plurality of light emitting elements is arranged in an axial direction (X or main-scanning direction) and a rotational direction (Y or sub-scanning direction) of the photoconductor drum. A plurality of rows of the light emitting elements is arranged in the Y direction for the purpose of improvement of resolution and so on. The control circuit 75, the drive circuits 76, and the memory 77 of the control section 70 are mounted on the FPC described above.

The light emitting elements 61 are mounted on the OPH panel V, and as is explained with reference to FIG. 13, on both the upstream and downstream sides of the OPH panel V in the rotational direction of the photoconductor drum, there are disposed drive circuits (driver ICs) 76*a*-76*d* mounted on the FPCs. The image data formed by the main controller 80 is transmitted to the control section 70, and temporarily stored in the memory 77. The control circuit 75 retrieves the image data stored in the memory 77, and forms a drive signal to supply each of the light emitting elements 61 with the drive signal via the drive circuits 76*a*-76*d*.

Figure 15:
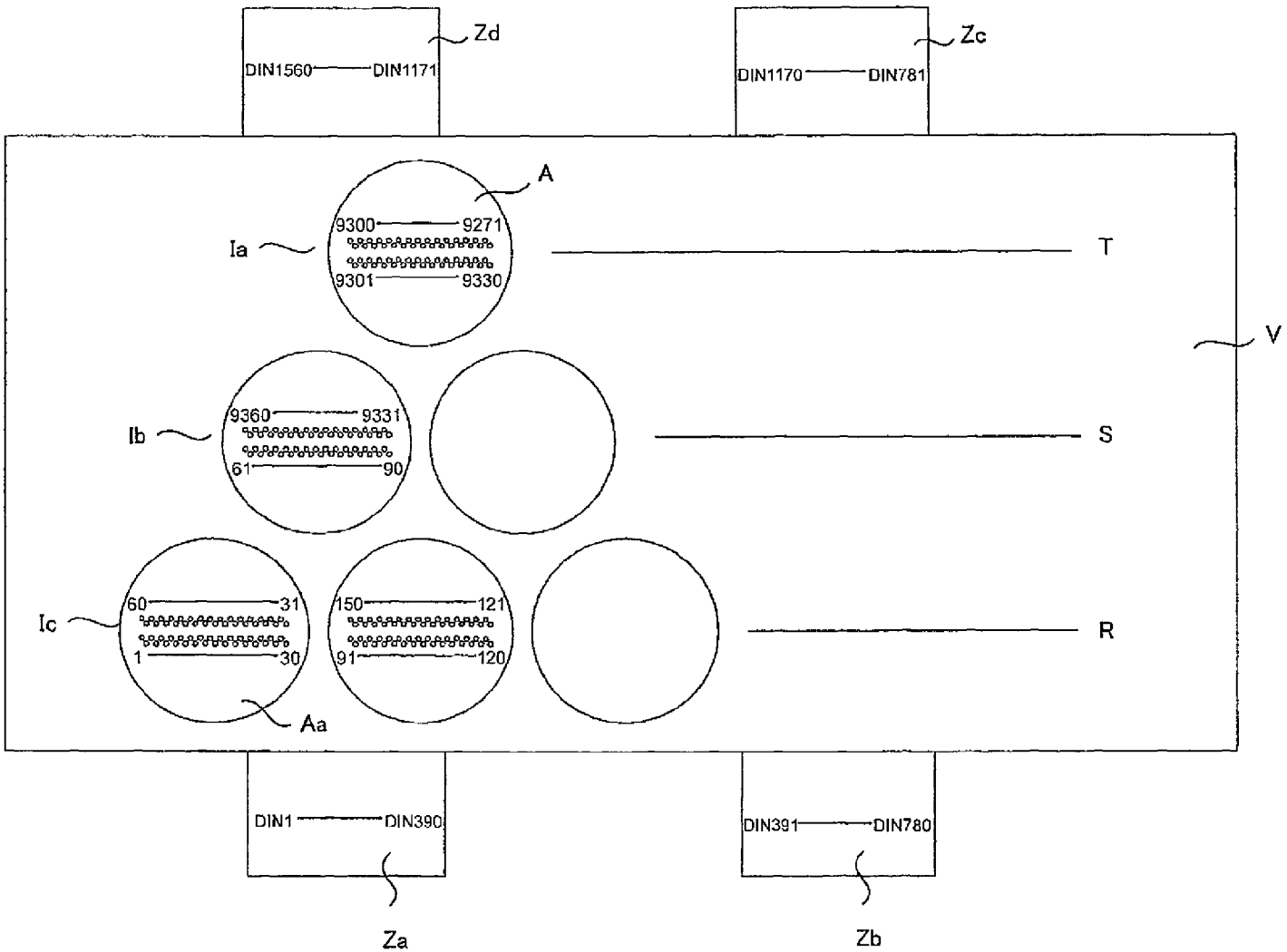
FIG. 15 is an explanatory diagram showing a connection example between FPCs and light emitting elements according to an embodiment of the invention.

FIG. 15 is an explanatory diagram showing a connection example between the FPCs and the light emitting elements. In FIG. 15, a plurality of light emitting elements is disposed in each of the microlenses and is provided with the output data of the driver IC by a multiplexer/demultiplexer (DMUX) in a sorting manner. Za-Zd denote the FPCs explained with reference to FIG. 13, and each of the FPCs is provided with the driver IC mounted thereon.

The FPC Za has connection terminals 1-390. Similarly, the FPC Zb has connection terminals 391-780, the FPC Zc has connection terminals 781-1170, and the FPC Zd has connection terminals 1171-1560. Each of the connection terminals is connected to six light emitting elements. Therefore, in the example shown in FIG. 15, 6×1560=9360 is obtained, and the total number of light emitting elements mounted on the OPH panel V is 9360.

Figure 16:
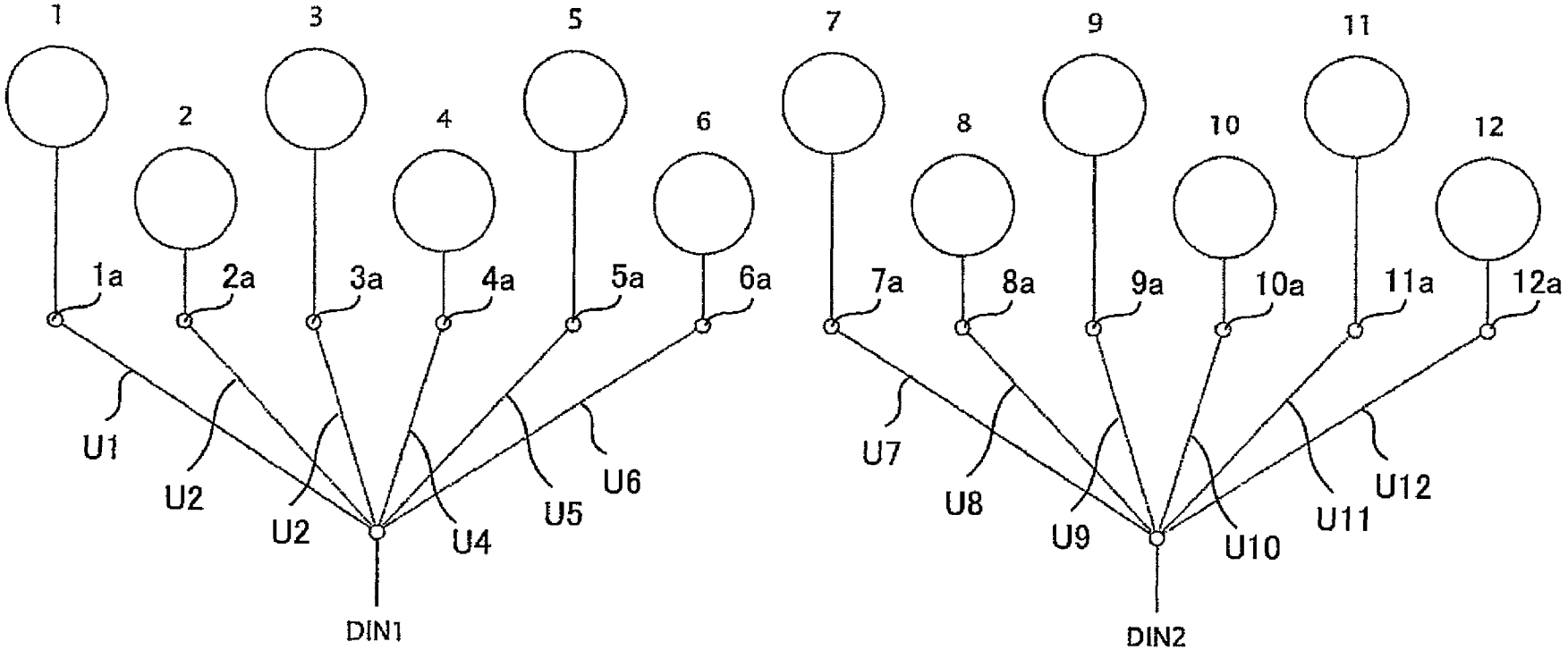
FIG. 16 is an explanatory diagram showing an example of electrically connecting connection terminals of the FPC to light emitting elements with the wiring of FIG. 15 according to an embodiment of the invention.

FIG. 16 is an explanatory diagram showing an example of electrically connecting each of the connection terminals of the FPC to the light emitting elements with the wiring in the configuration explained with reference to FIG. 15. FIG. 16 shows a connection example between the connection terminal 1 of the FPC Za and six light emitting elements 1-6, and a connection example between the connection terminal 2 and six light emitting elements 7-12. The light emitting elements 1-12 are provided with the connection terminals 1*a*-12*a*, respectively. The connection terminal 1 of the FPC Za and the connection terminals 1*a*-6*a* of the light emitting elements 1-6 are connected to each other via wires U1-U6, respectively. Further, the connection terminal 2 of the FPC Za and the connection terminals 7*a*-12*a* of the light emitting elements 7-12 are connected to each other via wires U7-U12, respectively. As described above, in the example of FIGS. 15 and 16, 60 light emitting elements are mounted with respect to each of the microlenses, and the data from the connection terminal DIN (DATA IN) of the FPC is sorted into 6 light emitting elements.

Figure 17:
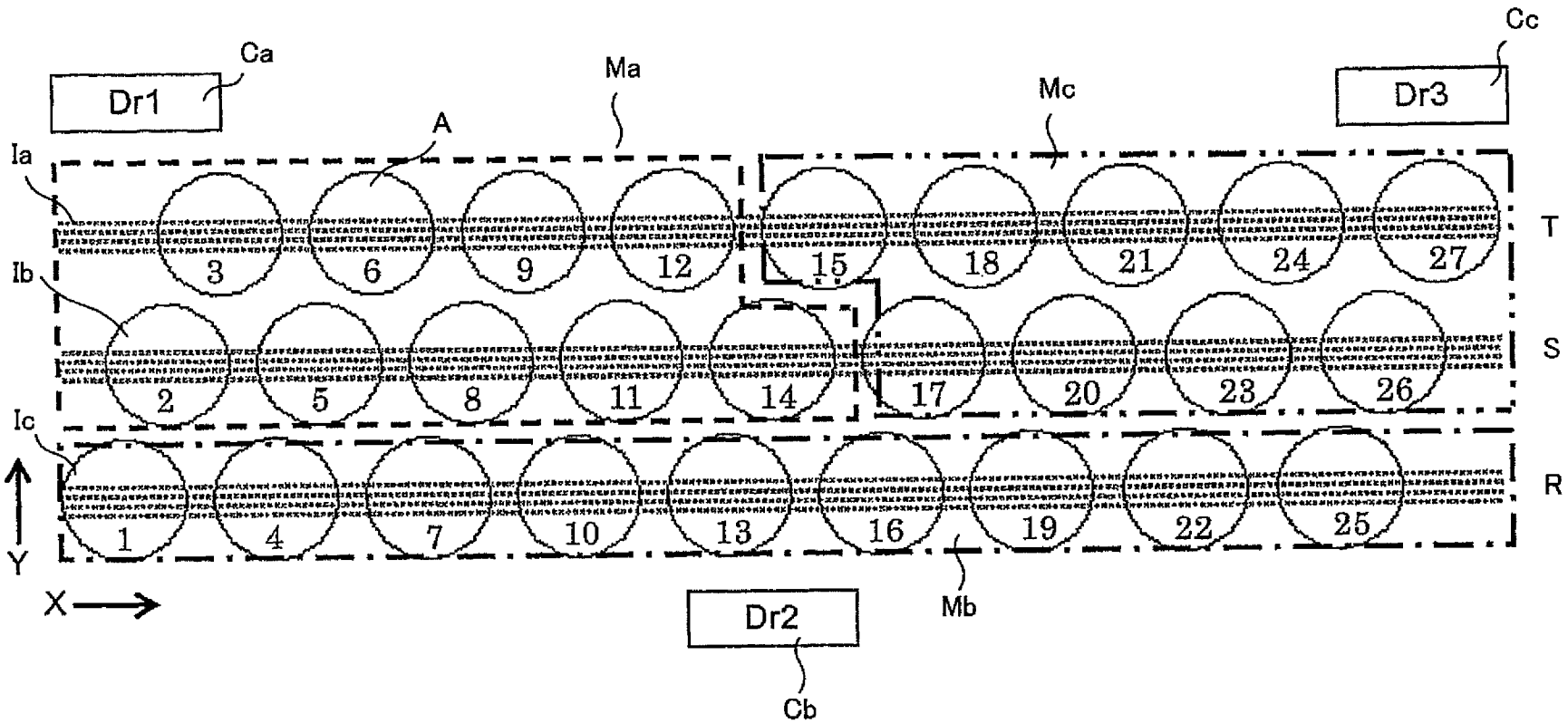
FIG. 17 is an explanatory diagram showing an embodiment of the invention.

Examples of mounting the drive circuits on the FPCs are now explained with reference to FIGS. 17-22. In FIGS. 17, 19 and 21, the FPCs are omitted from the illustrations. In the example of FIG. 10, the three light emitting element rows Ia-Ic are provided, the three driver ICs Dr1-Dr3 are provided, and each of the driver ICs is connected to the light emitting elements respectively included in all of the light emitting element rows Ia-Ic with the wiring. Therefore, it is conceivable that the lengths of the wires connecting the driver ICs and the light emitting elements respectively included in the light emitting element rows increase. The examples of FIGS. 17, 19 and 21 improve the configuration of the wiring between the light emitting elements included in the respective light emitting element rows and the driver ICs as shown in FIG. 10. FIG. 17 shows an example in which three imaging lens rows R, S and T are provided, and control of the light emitting elements is executed for each of the imaging lenses. The three light emitting element rows Ia-Ic are disposed in the rotational direction of the photoconductor drum. One driver IC Dr2 is disposed on the upstream side in the rotational direction of the photoconductor drum, and two driver ICs Dr1, Dr3 are disposed on the downstream side. The imaging lenses corresponding to the light emitting elements driven by the driver Dr1 are illustrated with the section Ma surrounded with the dot line (Dr1), the imaging lenses corresponding to the light emitting elements driven by the driver Dr2 are illustrated with the section Mb surrounded with the dashed line (Dr2), and the imaging lenses corresponding to the light emitting elements driven by the driver Dr3 are illustrated with the section Mc surrounded with the double-dashed line (Dr3).

In FIG. 17, the driver IC Dr1 controls the light emitting elements corresponding to the imaging lenses 3, 6, 9, 12, 2, 5, 8, 11 and 14, the driver IC Dr2 controls the light emitting elements corresponding to the imaging lenses 1, 4, 7, 10, 13, 16, 19, 22 and 25, and the driver IC Dr3 controls the light emitting elements corresponding to the imaging lenses 15, 18, 21, 24, 27, 17, 20, 23 and 26.

The driver IC Dr1 controls light emitting elements included in the two rows Ia and Ib, the driver IC Dr2 controls the light emitting elements included in the one row Ic, and the driver IC Dr3 controls light emitting elements included in the two rows Ia and Ib. As described above, when the number of light emitting element rows in the rotational direction of the photoconductor drum is n, each of the driver ICs is connected with the wiring to light emitting elements included in a number of light emitting element rows equal to or smaller than n−1. Here, n−1>1 is required. Therefore, a wiring more rational than a case in which each of the driver ICs is connected with wiring to the light emitting elements included in all of the light emitting element rows is formed, and the wiring treatment is simplified.

Figure 18:
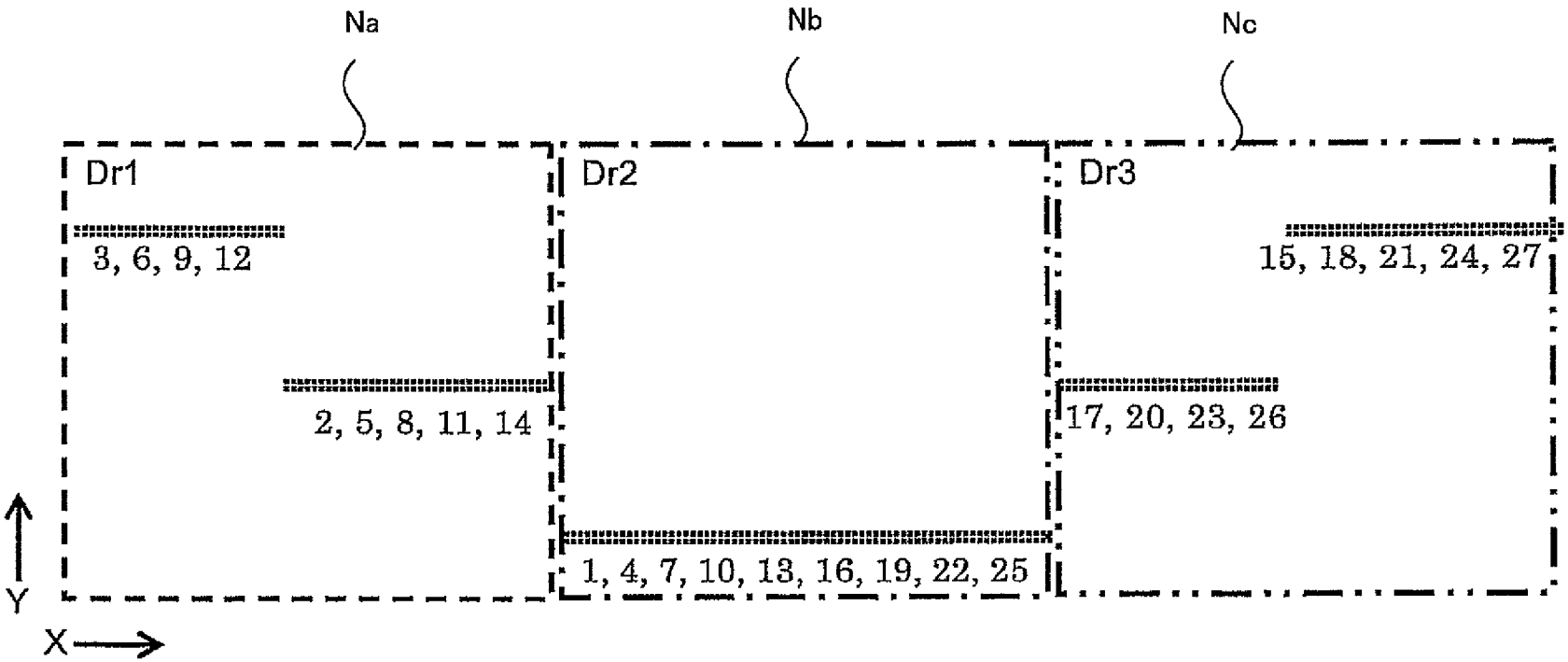
FIG. 18 is an explanatory diagram showing reordering of image data corresponding to the example of FIG. 17 according to an embodiment of the invention.
Figure 19:
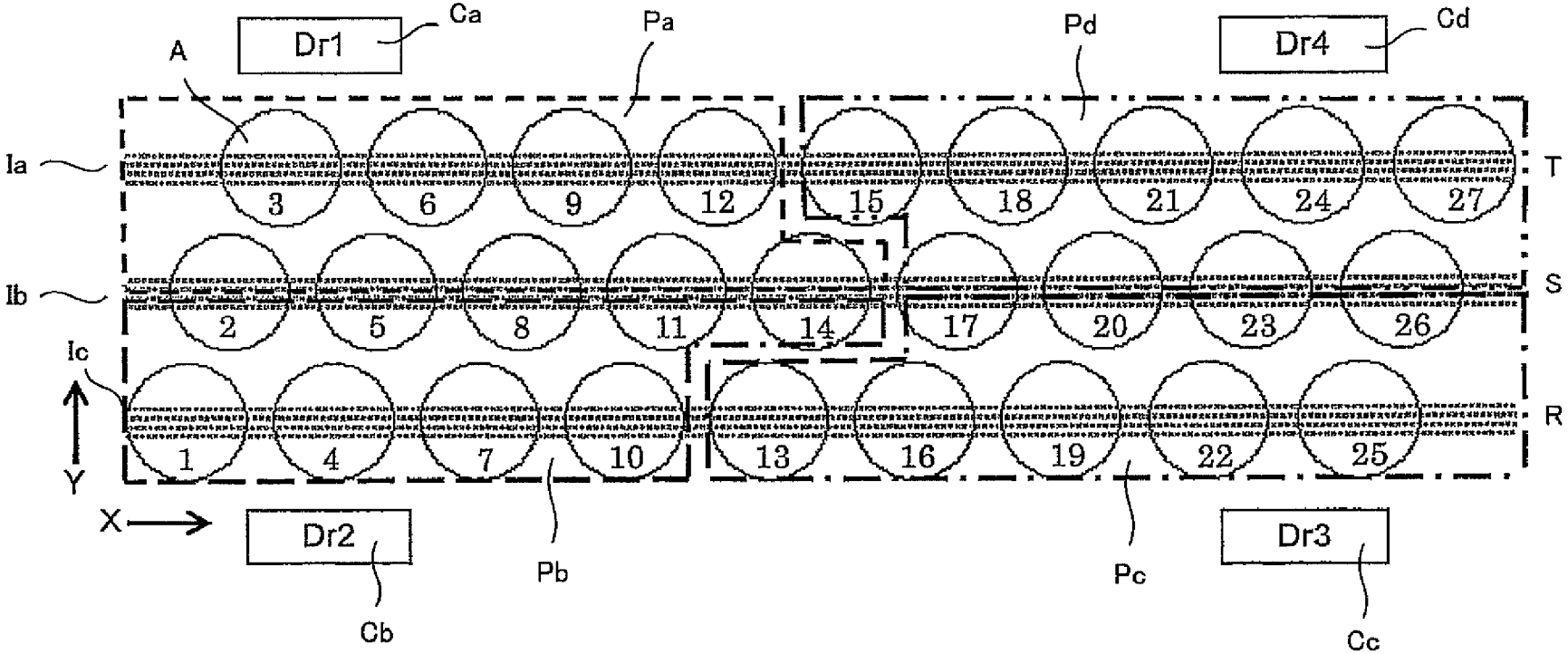
FIG. 19 is an explanatory diagram showing an embodiment of the invention.

FIG. 18 is an explanatory diagram showing the reordering of the image data corresponding to the example of FIG. 17. In FIG. 17, the wiring between the light emitting elements corresponding to the imaging lenses and the driver IC is made in the order from the light emitting elements to be connected to the driver IC Dr1 to the light emitting elements to be connected to the driver IC Dr3. The range of the reordering of the image data corresponding to the light emitting elements controlled by the driver IC Dr1 to the light emitting elements corresponding to the imaging lenses is denoted with Na, the range of the reordering of the image data corresponding to the light emitting elements controlled by the driver IC Dr2 is denoted with Nb, and the range of the reordering of the image data corresponding to the light emitting elements controlled by the driver IC Dr3 is denoted with Nc. By thus executing the reordering of the image data, one line of a linear latent image is formed on the photoconductor drum.

FIG. 19 is an explanatory diagram of an example embodiment of the invention in which three imaging lens rows R, S and T are provided, and the control of the light emitting elements is executed for each of the light emitting element rows. Three light emitting element rows Ia-Ic are disposed in the rotational direction of the photoconductor drum. Two driver ICs Dr2, Dr3 for controlling light emitting elements are provided on the upstream side in the rotational direction of the photoconductor drum, and two driver ICs Dr1, Dr4 are provided on the downstream side.

Light emitting element rows including light emitting elements driven by the driver Dr are illustrated with the section Pa surrounded with the dot line (Dr1), light emitting element rows including light emitting elements driven by the driver Dr2 are illustrated with the section Pb surrounded with the broken line (Dr2), light emitting element rows including light emitting elements driven by the driver Dr3 are illustrated with the section Pc surrounded with the dashed line (Dr3), and light emitting element rows including light emitting elements driven by the driver Dr4 are illustrated with the section Pd surrounded with the double dashed line (Dr4). In FIG. 19, each of the driver ICs Dr1-Dr4 is connected to light emitting elements including in two of the three light emitting element rows Ia-Ic arranged in the rotational direction of the photoconductor drum. The wiring treatment is thereby simplified.

Figure 20:
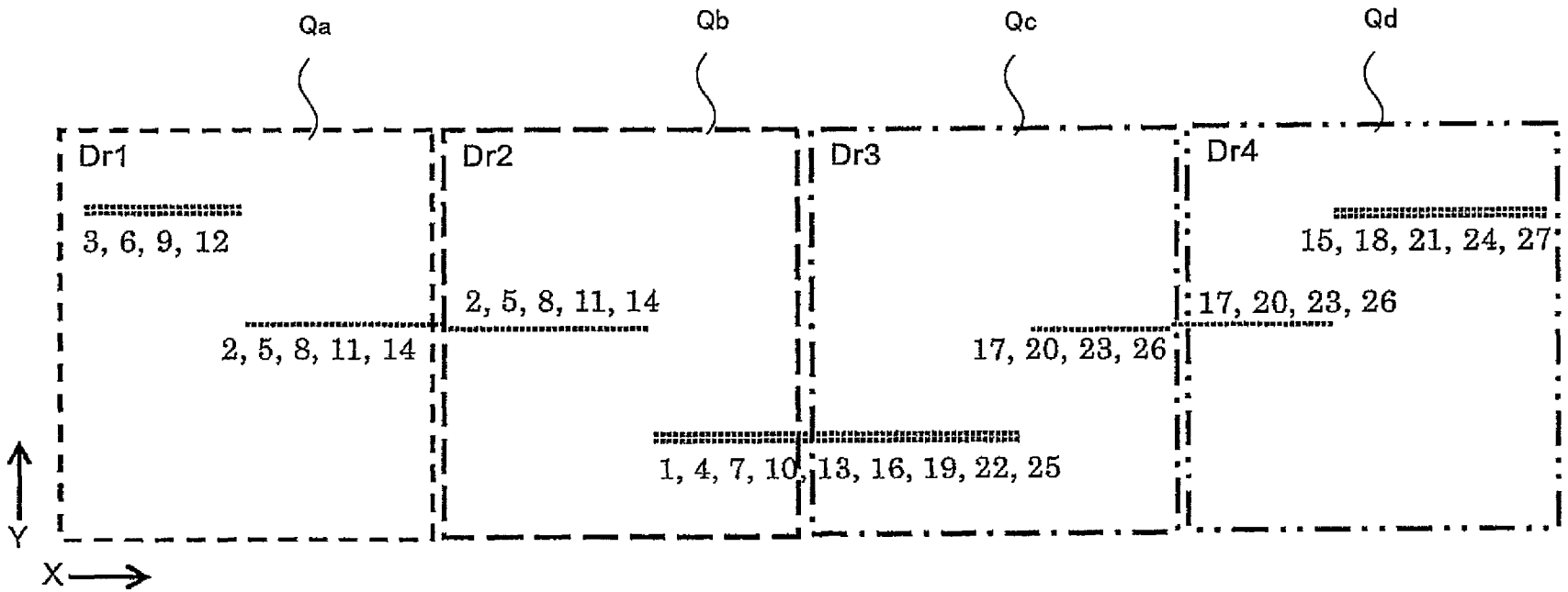
FIG. 20 is an explanatory diagram showing reordering of image data corresponding to the example of FIG. 19 according to an embodiment of the invention.
Figure 21:
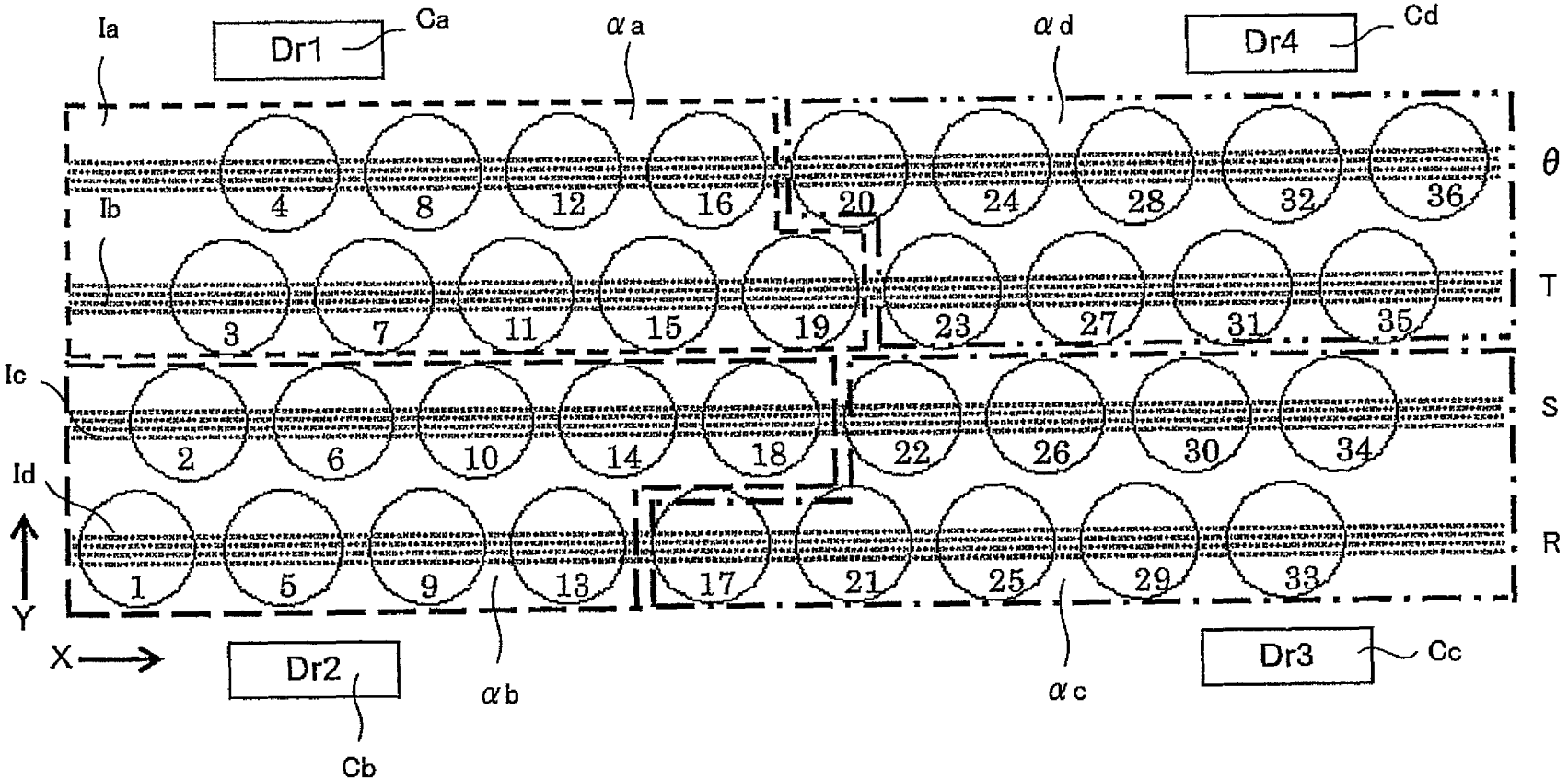
FIG. 21 is an explanatory diagram showing an embodiment of the invention.

FIG. 20 is an explanatory diagram showing the reordering of the image data corresponding to the example of FIG. 19. In FIG. 20, each of the light emitting element rows Ia-Ic is provided with four light emitting element rows arranged in the rotational direction of the photoconductor drum. The driver IC Dr1 controls light emitting elements in the light emitting element row 1*a* corresponding to the imaging lenses 3, 6, 9 and 12, and in the upper light emitting element rows of the light emitting element row 1*b* corresponding to the imaging lenses 2, 5, 8, 11 and 14.

The driver IC Dr2 controls light emitting elements of the lower light emitting element rows of the light emitting element row 1*b* corresponding to the imaging lenses 2, 5, 8, 11 and 14, and light emitting elements of the light emitting element row Ic corresponding to the imaging lenses 1, 4, 7 and 10. The driver IC Dr3 controls light emitting elements of the light emitting element row Ic corresponding to the imaging lenses 13, 16, 19, 22 and 25, and light emitting elements of the lower light emitting element rows of the light emitting element row Ib corresponding to the imaging lenses 17, 20, 23 and 26. The driver IC Dr4 controls light emitting elements of the upper light emitting element rows of the light emitting element row 1*b* corresponding to the imaging lenses 17, 20, 23 and 26, and light emitting elements of the light emitting element row Ia corresponding to the imaging lenses 15, 18, 21, 24 and 27.

Qa-Qd represent the ranges of the reordering of the image data corresponding to the light emitting elements controlled by the driver ICs Dr1-Dr4, respectively. The wiring between the light emitting elements of the light emitting element rows corresponding to the imaging lenses and the driver IC is made in the order from the light emitting elements to be connected to the driver IC Dr1 to the light emitting elements to be connected to the driver IC Dr4. In this case, by thus executing the reordering of the image data as shown in FIG. 20, one line of a linear latent image is formed on the photoconductor drum.

FIG. 21 is an explanatory diagram of an example embodiment of the invention in which four imaging lens rows R, S, T and θ are provided, and the control of the light emitting elements is executed for each of the imaging lenses. The four light emitting element rows Ia-Id are disposed in the rotational direction of the photoconductor drum. Two driver ICs Dr2, Dr3 for controlling light emitting elements are provided on the upstream side in the rotational direction of the photoconductor drum, and two driver ICs Dr1, Dr4 are provided on the downstream side.

Light emitting element rows including light emitting elements driven by the driver Dr1 are illustrated with the section αa surrounded with the dot line (Dr1), light emitting element rows including light emitting elements driven by the driver Dr2 are illustrated with the section αb surrounded with the broken line (Dr2), light emitting element rows including light emitting elements driven by the driver Dr3 are illustrated with the section ac surrounded with the dashed line (Dr3), and light emitting element rows including light emitting elements driven by the driver Dr4 are illustrated with the section ad surrounded with the double dashed line (Dr4). In FIG. 21, each of the driver ICs Dr1-Dr4 is connected to light emitting elements included in two of the four light emitting element rows Ia-Id. The wiring treatment is thereby simplified.

In this example, the driver IC Dr1 controls light emitting elements of the light emitting element rows 1*a*, 1*b*, corresponding to the imaging lenses 4, 8, 12, 16, 3, 7, 11, and 19. The driver IC Dr2 controls light emitting elements of the light emitting element rows Ic, Id corresponding to the imaging lenses 2, 6, 10, 14, 18, 1, 5, 9 and 13. The driver IC Dr3 controls light emitting elements of the light emitting element rows Ic, Id corresponding to the imaging lenses 20, 24, 28, 32, 36, 23, 27, 31 and 35. The driver IC Dr4 controls light emitting elements of the light emitting element rows Ia, Ib corresponding to the imaging lenses 22, 26, 30, 34, 17, 21, 25, 29 and 33.

Figure 22:
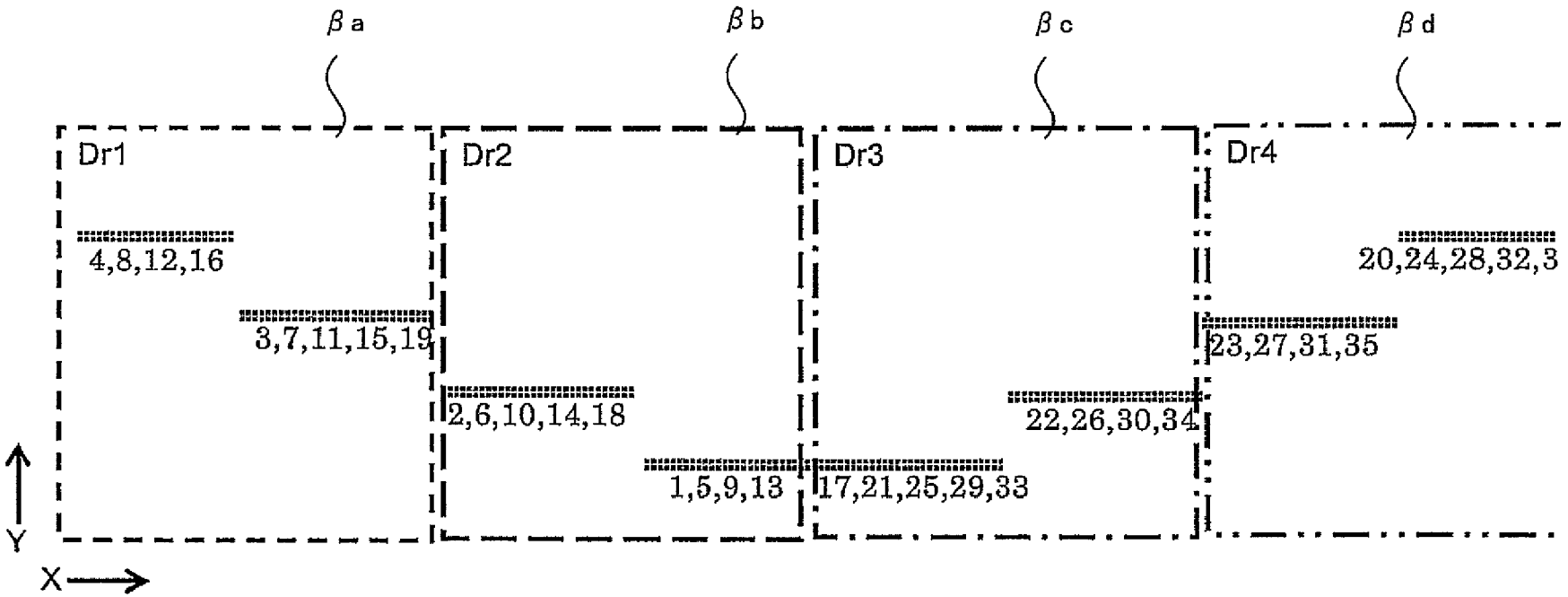
FIG. 22 is an explanatory diagram showing reordering of image data corresponding to the example of FIG. 21 according to an embodiment of the invention.

FIG. 22 is an explanatory diagram showing the reordering of the image data corresponding to the example of FIG. 21. In FIG. 22, the wiring between the light emitting elements corresponding to the imaging lenses and the driver IC is made in the order from the light emitting elements to be connected to the driver IC Dr1 to the light emitting elements to be connected to the driver IC Dr4. The range of the reordering of the image data corresponding to the light emitting elements controlled by the driver IC Dr1 to the light emitting elements corresponding to the imaging lenses is denoted with βa, the range of the reordering of the image data corresponding to the light emitting elements controlled by the driver IC Dr2 is denoted with βb, the range of the reordering of the image data corresponding to the light emitting elements controlled by the driver IC Dr3 is denoted with βc, and the range of the reordering of the image data corresponding to the light emitting elements controlled by the driver IC Dr4 is denoted with βd. By thus executing the reordering of the image data, one line of a linear latent image is formed on the photoconductor drum.

In the embodiment of the invention, as shown in FIG. 1, the driving circuit is disposed on one side of the substrate in the rotational direction of the photoconductor drum. Therefore, the space on the other side where no drive circuit is disposed can be saved. Although not shown in the drawings, drive circuits may also be disposed on both sides of the substrate in the rotational direction of the photoconductor drum. On this occasion, since the light emitting elements close to the drive circuit can be connected to the driver with the wiring, the length of the wire can be reduced.

In the case of mounting the drive circuits on the FPCs, as shown in FIG. 13, the FPCs are disposed on both sides of the substrate in the rotational direction of the photoconductor drum. In this case, the control section of the line head is disposed on the substrate in a balanced manner. Further, the number of FPCs provided to each side of the substrate can be made different, as shown in FIG. 17, where one FPC is provided to one side and two FPCs are provided to the other side. In this case, when the plurality of light emitting element rows is disposed on the substrate in the rotational direction of the photoconductor drum, the control sections for the respective light emitting element rows can rationalistically be disposed. In FIG. 17, the driver IC Dr2 mounted on the FPC disposed on one side of the substrate controls the light emitting element row Ic on the upstream side in the rotational direction of the photoconductor drum, and the freedom of configuration of the line head is enhanced.

The number of FPCs provided to each side of the substrate can be the same as shown in FIGS. 19, 21 where the number of FPCs is two on the both sides. In FIG. 19, three light emitting element rows and four FPCs are provided, and since the number of FPCs exceeds the number of light emitting element rows, the load of controlling the light emitting elements is reduced. In FIG. 22, four light emitting element rows and four FPCs are provided, i.e., the number of light emitting element rows and the number of FPCs are equal. In this case, a plurality of light emitting elements arranged on the substrate in the axial and rotational directions of the photoconductor drum can be sectioned according to needs, and the control of the groups of the light emitting elements thus sectioned can be performed by the control section of the FPC disposed closest to the light emitting element groups in a rational manner.

The line head and the image forming device using the line head according to the invention are hereinabove explained based on the principle thereof and the embodiments. However, the invention is not limited to such embodiments, and various modifications are possible.

What is claimed is:

1. An image forming device comprising:

a photoconductor drum;

a line head including a substrate, a plurality of light emitting elements disposed on the substrate, at least one drive circuit that drives the light emitting elements, a plurality of wirings that electrically connect the drive circuit and the light emitting elements, and at least one imaging optical system that images light from the light emitting elements;

at least one flexible printed circuit board electrically connected to the wirings; and a control section that supplies the line head with image data, wherein the light emitting elements form n (n is an integral number equal to or greater than 2) light emitting element rows in the rotational direction of the photoconductor drum, at least one of the drive circuits is electrically connected with the wirings to light emitting elements belonging to a number of light emitting element rows equal to or smaller than n−1, the drive circuits are disposed on the flexible printed circuit board, and the flexible printed circuit boards that mount the drive circuits are disposed on both sides of the substrate in the rotational direction of the photoconductor drum, and the number of flexible printed circuit boards disposed on one side of the substrate in the rotational direction of the photoconductor drum and the number of flexible printed circuit boards disposed on the other side of the substrate are different from each other.

2. The image forming device according to claim 1, wherein the imaging optical system has negative optical power.

3. The image forming device according to claim 2, further comprising:

a control section supplied with image data used for forming a latent image on the photoconductor drum, wherein the control section reverses the image data supplied to the light emitting element rows in an axial direction and the rotational direction of the photoconductor drum to reorder the image data.

4. The image forming device according to claim 2, further comprising:

a control section supplied with image data used for forming a latent image on the photoconductor drum, wherein the control section executes reordering of the image data transmitted to every light emitting element row in an axial direction and the rotational direction of the photoconductor drum in accordance with a configuration of the wirings electrically connecting the drive circuit and the light emitting elements.

5. The image forming device according to claim 1, wherein the drive circuit is disposed on one side of the substrate in the rotational direction of the photoconductor drum.

6. The image forming device according to claim 1, wherein the drive circuits are disposed on both sides of the substrate in the rotational direction of the photoconductor drum.

* * * * *